United States Patent [19]

Iwanami et al.

[11] Patent Number: 4,886,423

[45] Date of Patent: Dec. 12, 1989

[54] VARIABLE DISPLACEMENT SWASH-PLATE TYPE COMPRESSOR

[75] Inventors: Shigeki Iwanami, Nishio; Mitsuo Inagaki; Hideaki Sasaya, both of Okazaki; Taro Tanaka, Nagoya; Akikazu Kojima, Gamagori, all of Japan

[73] Assignee: Nippon Soken, Inc., Nishio, Japan

[21] Appl. No.: 147,036

[22] Filed: Jan. 20, 1988

Related U.S. Application Data

[63] Continuation-in-part of Ser. No. 91,982, Sep. 1, 1987, abandoned.

[30] Foreign Application Priority Data

| | | | |
|---|---|---|---|
| Sep. 2, 1986 | [JP] | Japan | 61-206229 |
| Dec. 18, 1986 | [JP] | Japan | 61-302296 |
| Jun. 19, 1987 | [JP] | Japan | 62-154139 |
| Sep. 1, 1987 | [JP] | Japan | 62-218548 |

[51] Int. Cl.[4] ..... F04B 1/26

[52] U.S. Cl. ..... 417/222; 92/12.2; 91/506

[58] Field of Search ..... 417/222; 92/12.2, 222 S; 91/506

[56] References Cited

U.S. PATENT DOCUMENTS

| | | | |
|---|---|---|---|
| 2,964,234 | 12/1960 | Loomis, III | 74/60 |
| 3,010,403 | 11/1961 | Zobaty | 417/222 |
| 3,861,829 | 1/1975 | Roberts et al. . | |
| 3,959,983 | 6/1976 | Roberts et al. . | |
| 4,061,443 | 12/1977 | Black | 92/122 |
| 4,108,577 | 8/1978 | Brucken | 417/270 |
| 4,425,837 | 1/1984 | Livesay | 417/269 |
| 4,664,604 | 5/1987 | Terauki | 417/222 |

FOREIGN PATENT DOCUMENTS

| | | | |
|---|---|---|---|
| 968435 | 1/1958 | Fed. Rep. of Germany | 417/222 |
| 58-162780 | 9/1983 | Japan . | |
| 58-162781 | 9/1983 | Japan . | |
| 58-162782 | 9/1983 | Japan . | |
| 58-162783 | 9/1983 | Japan . | |

*Primary Examiner*—William L. Freeh

*Attorney, Agent, or Firm*—Cushman, Darby & Cushman

[57] ABSTRACT

A variable displacement swash-plate type compressor suitable for use as a refrigerant compressor of an automotive air conditioner has a cylinder block having a plurality of cylinder bores each slidably receiving a double-headed piston, a shaft driven by an automotive engine, a swash plate tiltably mounted on the shaft for rotation therewith to reciprocatorily move the pistons, and a spool for moving the swash plate axially of the shaft and changing the angle of tilt of the swash plate. The swash plate and the shaft are connected in such a manner that, when the swash plate is axially moved while changing its tilting angle, the position of stroke end of each piston is changed only in a working chamber on one end of the piston, whereas no change in the position of the stroke end occurs in the other working chamber on the other end of the piston.

34 Claims, 47 Drawing Sheets

VARIABLE DISPLACEMENT SWASH-PLATE TYPE COMPRESSOR

This is a continuation-in-part of application Ser. No. 091,982, filed Sept. 1, 1987, which was abandoned upon the filing hereof.

BACKGROUND OF THE PRESENT INVENTION

The present invention relates to a variable displacement swash-plate type compressor suitable for use as a refrigerant compressor in automotive air conditioners and, more particularly, to displacement control in such type of compressor.

A variable displacement swash-plate type compressor has been known in which the angle of tilt of a swash plate is linearly changed so as to effect a linear control of displacement between 0% and 100% as shown, for example, in Japanese Unexamined Patent Publication No. 58-162780. This known swash-plate type compressor, however, suffers from the following problem: Namely, a decrease in the angle of tilt of the swash plate in this compressor causes not only a reduction in the piston stroke but also an increase in the dead volume on each rear side of each piston of the compressor. The increase in the dead volume in turn causes a problem that, due to expansion of the gas in the dead volume, the displacement of the compressor is significantly changed even with a slight change in the tilting angle of the swash plate.

In order to obviate this problem, Japanese Unexamined Patent Publication No. 60-175783 discloses a swash-plate type compressor which does not employ double-headed pistons but utilizes a swash plate arranged such that the angle and the position of the swash plate are changed by the control of a pressure acting on the rear side of each piston so that the dead volumes are not changed when the tilting angle is decreased. Thus, in this swash-plate type compressor, pistons are provided only on one side of the swash plate, so that the pressure of the gas discharged from the compressor greatly pulsates and the torque required for driving the compressor fluctuates undesirably. In addition, the capacity or displacement per size of the compressor is limited.

In order to obviate this problem, it is preferred that the compressor employs a double-headed piston type mechanism, i.e., pistons arranged on both sides of a swash plate. In this double-headed piston type, however, it is impossible to make use of back pressure acting on the rear sides of the pistons for the purpose of controlling the angle and position of the swash plate because working chambers are provided on both sides of the swash plate.

SUMMARY OF THE INVENTION

Accordingly, a first object of the present invention is to provide a swash-plate type compressor in which double-headed pistons are provided and in which the displacement of the compressor is linearly changed while avoiding similar increases in the dead volumes on both rear sides of each piston.

A second object of the present invention is to provide a swash-plate type compressor capable of linearly controlling the displacement with good response to a displacement control input.

A third object of the present invention is to provide a swash-plate type compressor wherein the displacement is linearly controlled with good response to a displacement control input and wherein the linear control of the displacement is possible even in an operating region in which the piston stroke has been slightly reduced from the maximum stroke, that is, in a condition in which the displacement is slightly reduced from the maximum displacement.

A fourth object of the present invention is to provide a swash-plate type compressor wherein the displacement is linearly controlled with good response to a displacement control input and wherein the linear control of the displacement is conducted without fail even in an operating region in which the piston stroke has been largely reduced from the maximum stroke; that is, the fourth object is to assure that the linear control of the displacement can be conducted down to the minimum displacement.

According to a first aspect of the present invention, there is provided a variable capacity swash-plate type compressor in which a swash plate, which is adapted to be rotationally driven by a shaft, decreases the angle of tilt thereof as a spool is moved along the shaft, thus changing the stroke of pistons. The swash plate is supported at its center by a spherical bearing which is also adapted to move in synchronization with the movement of the spool. In this compressor, no substantial increase in the dead volume occurs in working chambers on one side of the swash plate, although dead volumes increase in the working chambers on the other side of the swash plate. In consequence, it becomes possible to progressively decrease the displacement of the compressor and, hence, to lineraly control the displacement of the compressor in response to the movement of the spool.

According to a second aspect of the present invention, there is provided a swash-plate type compressor in which an axial movement of a spool for controlling the angle of tilt of the swash plate is controlled by varying internal pressure in a control pressure chamber by means of a control valve. Therefore, the angle of tilt of the swash plate can be changed linearly and with good response by the operation of the control valve.

According to a third aspect of the present invention, there is provided a swash-plate type compressor having auxiliary spool urging means which assist a spool in making an axial movement when the amount of decrease in the piston stroke is comparatively small, i.e., when the displacement of the compressor has been reduced slightly from the maximum displacement. In an operating region where the displacement of the compressor has been slightly reduced from the maximum displacement, smooth movement of the spool tends to be impaired due to influence by a dead space formed in working chambers on one side of the pistons. Such a problem, however, can be overcome by the compressor of the third aspect of the invention which incorporates the auxiliary spool urging means which assists the spool when the spool makes an axial movement so as to ensure a smooth movement of the spool when the compressor operates in an operating region where the displacement has been slightly reduced from the maximum displacement.

According to a fourth aspect of the present invention, there is provided a swash-plate type compressor having auxiliary tilting means adapted to urge the swash plate to the minimum tilt angle position where the piston stroke and, hence, the displacement of the compressor are minimized. In general, when the displacement of a piston has been decreased almost to the minimum level, a further tilting of the swash plate to the minimum tilting angle tends to be resisted by a force which is produced by pressure differential across the piston. In the swash-plate type compressor according to the fourth aspect of the present invention, however, this problem is overcome because the auxiliary tilting means operates to ensure that the swash plate can be tilted to the minimum tilting angle to enable the compressor to linearly and smoothly change its displacement to the minimum value.

DESCRIPTION OF THE PREFERRED EMBODIMENTS

Preferred embodiments of the swash-plate type compressor in accordance with the present invention will be described in detail hereinunder with reference to the accompanying drawings.

Figure 1:
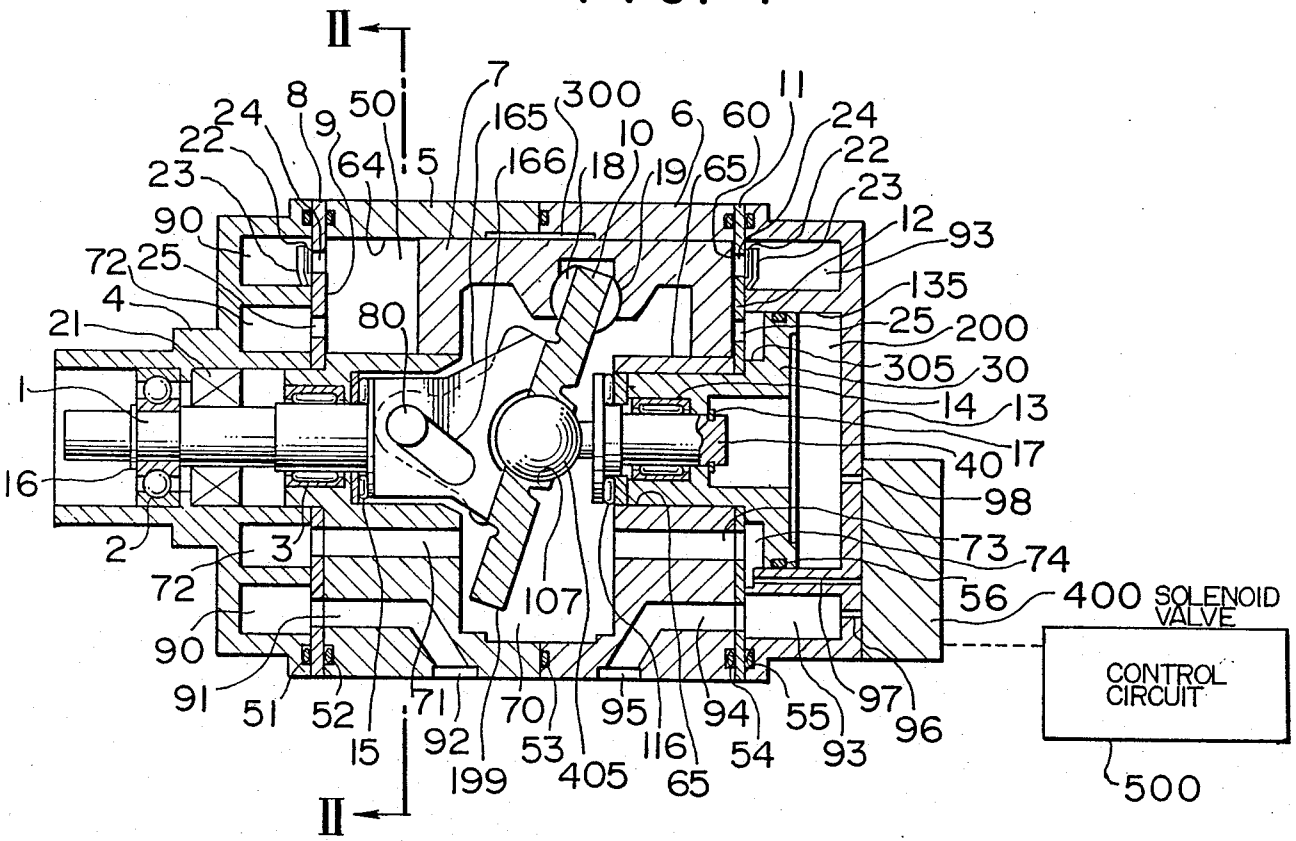
FIG. 1 is an axial sectional view of an embodiment of a swash-plate type compressor in accordance with the present invention.

FIG. 1 is a longitudinal sectional view of a variable displacement swash-plate type compressor in accordance with the present invention.

The compressor has an outer shell which is composed of the following parts assembled together by through bolts not shown: a front housing 4 made of an aluminum alloy; a front side plate 8; a suction valve 9; a front cylinder block 5; a rear cylinder block 6; a suction valve 12; a rear side plate 11 and a rear housing 13. As will be seen from FIG. 2, each of the cylinder blocks 5 and 6 is provided with five cylinder bores 64–1 to 64–5 formed therein in parallel with one another.

The compressor further has a shaft 1 which is rotatably supported on the front housing 4 and the front cylinder block 5 through bearings 2 and 3 and which is adapted to be driven by the power of an automotive engine which is not shown. During operaiton of the compressor, a thrust force is generated to act on the shaft 1 so as to urge the shaft to the left as viewed in FIG. 1. This thrust force is born by the front cylinder block 5 through a thrust bearing 15. A stopper ring 16 is provided for the purpose of preventing the shaft 1 from moving to the right as viewed in FIG. 1 by a reactional force. The stopper ring 16 is retained in an annular groove formed in the surface of the shaft 1.

A rear shaft 40 is rotatably mounted in a spool 30 through a bearing 14. A thrust force which acts on the rear shaft 40 rightwards as viewed in FIG. 1 is born by the spool 30 through a thrust bearing 116. A stopper ring 17, which is retained in an annular groove formed in the surface of the rear shaft 40 prevents the rear shaft 40 from coming off the spool 30. The spool 30 is axially slidably received in a cylindrical portion 65 of the rear cylinder block 6 and a cylindrical portion 135 of the rear housing 13.

A swash plate 10 is provided on the center thereof with a spherical surface portion 107 which receives a spherical support portion 405 of the rear shaft 40 so that the swash plate 10 is rockably supported by the spherical support portion 405.

Figure 3:
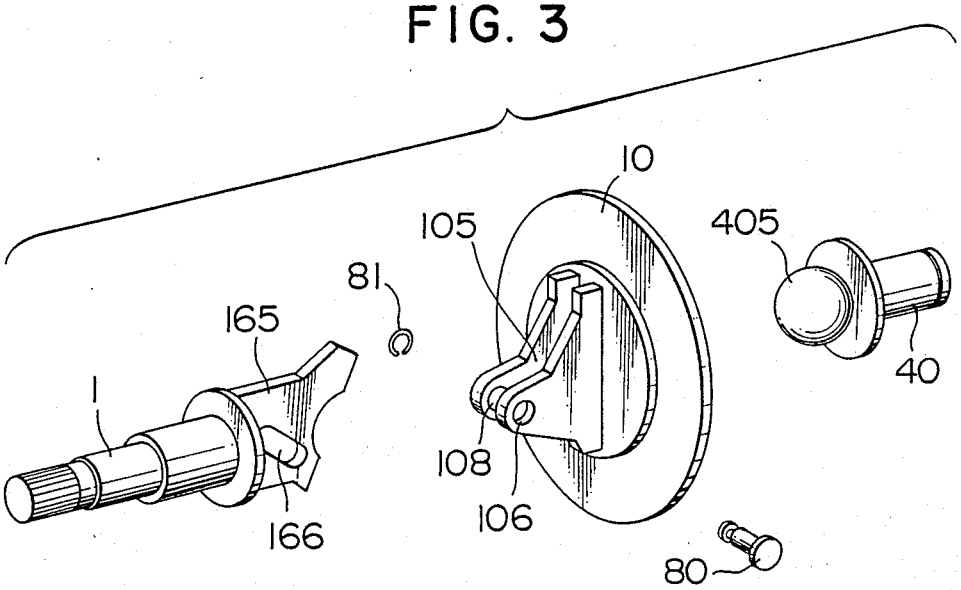
FIG. 3 is an exploded perspective view of an essential portion of the compressor shown in FIG. 1.

The shaft 1, the swash plate 10 and the rear shaft 40 are shown in an exploded perspective view in FIG. 3. As will be seen from FIG. 3, the swash plate 10 is provided on its side adjacent to the shaft 1 with opposing walls defining a slit 105 which is adapted to receive a flat web portion 165 formed on the end of the shaft 1 adjacent to the swash plate 10. The flat web portion 165 makes a face-to-face contact with the opposing wall surfaces of the slit 105 so that a torque applied to the shaft 1 is transmitted to the swash plate 10.

Shoes 18 and 19 are slidably disposed on both sides of the swash plate 10. The cylinder bores 64 in the front cylinder block 5 and the rear cylinder block 5 slidably receive pistons 7. The shoes 18 and 19, which slidably engage with the swash plate 10 as stated above, rotatably engage with inner surfaces of the pistons 7. In consequence, an oscillatory rotational movement of the swash plate 10 is converted into reciprocatory motions of the pistons 7 through the shoes 18 and 19. The shoes 18 and 19 are so designed and sized that their outer surfaces constitute parts of a common sphere when they are assembled in the compressor.

The aforementioned flat web portion 165 of the shaft 1 is provided with an elongated slot 166, while the swash plate 10 is provided with pin-receiving holes formed in the opposing walls which define the slit 105. After the flat web portion 165 is placed in the slit 105, a pin 80 is inserted into the holes 105 and 108 through the elongated slot 166 so as to pivotally and movably connect the swash plate 10 to the shaft 1. A stopper ring 81 is provided on one end of the pin 80 to prevent the pin 80 from coming off these holes. The angle of tilt of the swash plate varies depending on a variable position of the pin 80 along the length of the elongated slot 166. A change of the position of the pin 80 also causes a change in the position of the center (the spherical surface portion 107 of the spherical support portion 405 of the rear shaft 40) of the swash plate. Namely, the elongated slot 166 is so designed that, even when the stroke of the piston 7 is changed due to a change of the angle of tilt of the swash plate 10, the top dead center of the piston 7 in a working chamber 60 on the right side of each piston as viewed in FIG. 1 is not changed substantially, thus eliminating substantial increase in the dead volume in this working chamber 60. In contrast, in a working chamber 50 which is disposed on the left side of each piston 7 as viewed in FIG. 1, the top dead center of the piston is changed as a result of a change of the angle of tilt of the swash plate, thus causing a change in the dead volume.

The elongated slot 166 is so shaped, sized and positioned such that the position of the top dead center of the piston 7 in the working chamber 60 is not changed substantially even when the angle of tilt of the swash plate is changed. To meet this requirement, the elongated slot 166 must have an arcuate form in a strict sense. Particularly, however, such an arcuate form can be well approximated by a substantially linear elongated slot. In the described embodiment, the elongated slot 166 is disposed on the axis of the shaft 1 so as to prevent the shape and size of the flat web portion 165 from becoming excessively large-sized due to provision of the elongated slot 166. The reduction in the size of the flat web portion 165, which is realized by positioning the elongated slot 166 on the axis of the shaft 1, is advantageous particularly in the swash-plate compressor of the type in which the flat web portion 165 is disposed inwardly of pistons.

Figure 40:
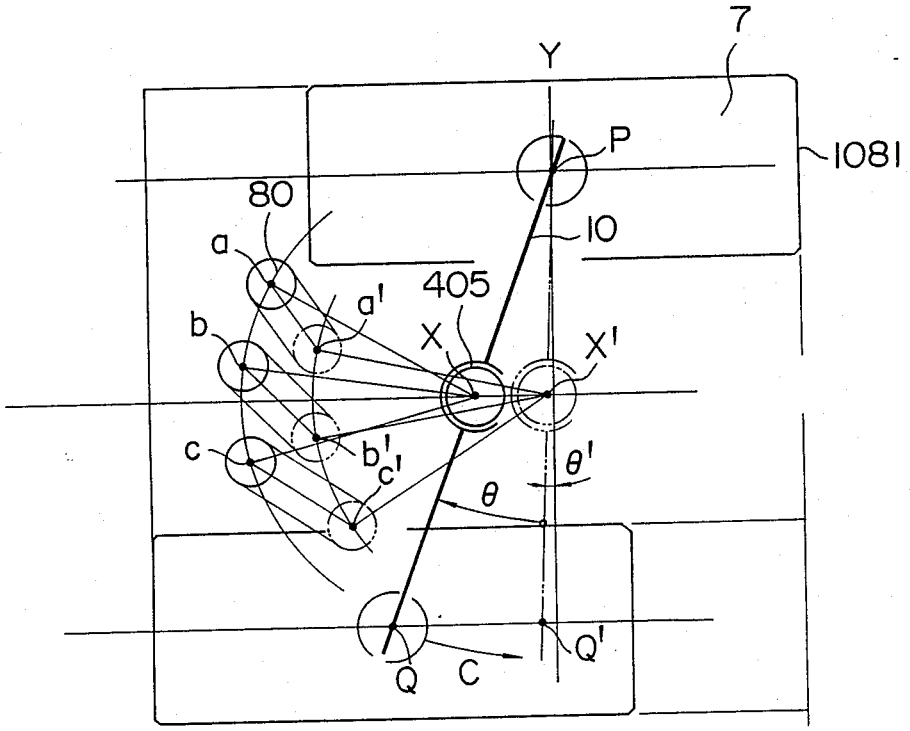
FIG. 40 is a diagrammatic illustration provided for the description of the shape of an engagement slot.

A detail description will be made hereinunder as to the configuration of the elongated hole 166 with specific reference to FIG. 40.

In the illustrated embodiment of the present invention, the compressor is structured such that the position of the top dead center of each piston 7 at the end denoted by 1081 is maintained substantially constant regardless of the change of the tilting angle of the swash plate 10. To this end, the compressor is designed such that the position of a point P shown in FIG. 40 is not changed, while the swash plate 10 is controllable between the maximum tilting position shown by solid line and the minimum tilting position shown by broken line. The point X represents the position of the center of the spherical support 405.

When the tilting angle of the swash plate 10 is changed, the position X of the center of rotation is also changed. In the embodiment of the invention, the transmission of the torque from the shaft 1 to the swash plate 10 is not conducted at the position of center of rotation but is conducted at the power transmitting portion which is constituted by the flat web portion 165 and the slit 105 and which is offset from the center of rotation.

As explained before, the transmission of the torque from the shaft 1 to the swash plate 10 relies upon the face-to-face contact between the flat web portion 165 and the surfaces of the walls defining the slit 105. In the described embodiment, in order to prevent the flat web portion 165 from coming off the slit 105, the flat web portion is connected to the walls defining the slit 105 by means of the pin 80 as explained before in connection with FIG. 3. In consequence, the locus of movement of the pin 80 is varied in accordance with a change in the tilting angle of the swash plate 10.

Figure 41:
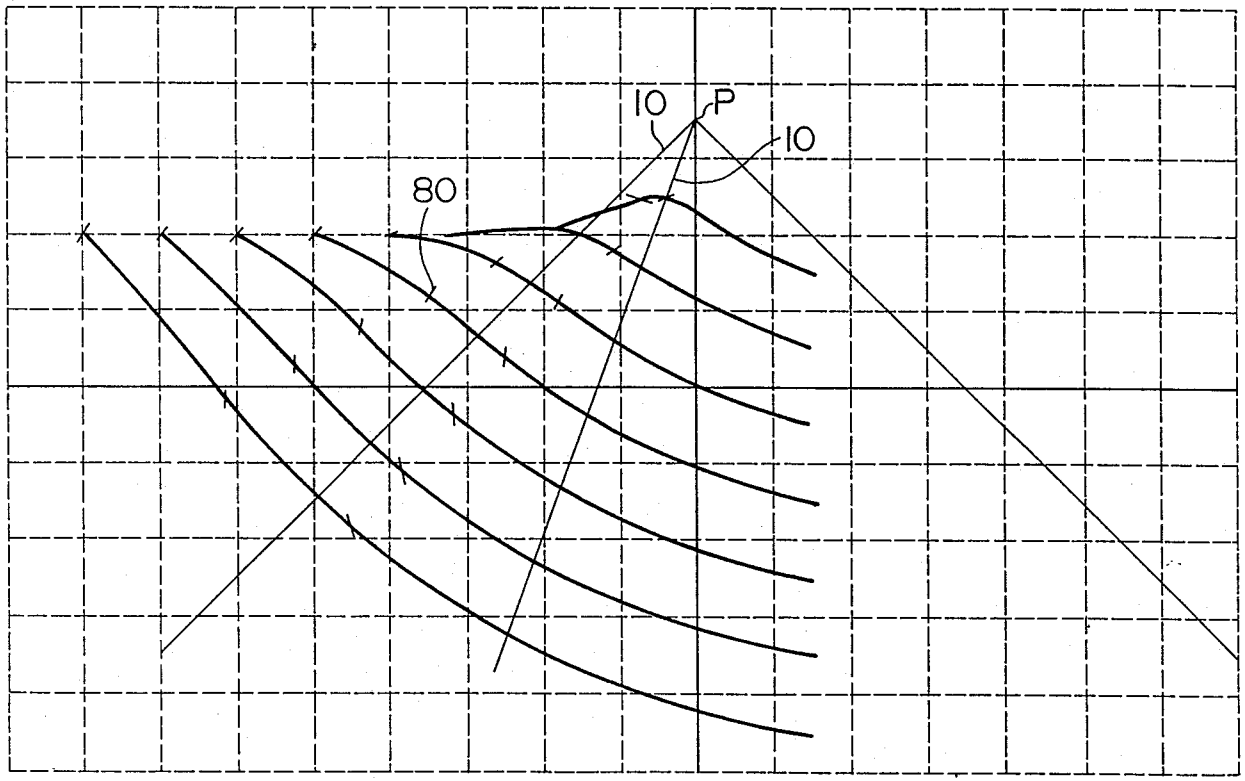
FIG. 41 is a diagrammatic illustration of loci of a pin engaged in the engagement slot.

The present inventors have made an intense study on the locus of movement of the pin 80 and obtained results which are shown in FIG. 41. As shown in this figure, it has been confirmed that the locus of movement of the pin can be approximated by a substantially linear line when the swash plate is tilted at a predetermined angle while the position P of top dead center of the piston is fixed, and particularly when the locus crosses the axis of the shaft 1. More specifically, when the tilting angle of the swash plate is around 20°, the locus of movement of the pin 80 is almost straight.

This is the reason why the elongated slot 166 defining the path of movement of the pin 80 is disposed in the vicinity of the axis of the shaft 1 so as to cross this axis.

The arrangement in which the elongated slot 166 is so disposed as to cross the axis of the shaft 1 also contributes to reduction in the size of the flat web portion 165. Namely, if the elongated slot 166 is disposed on a line a—a' or c—c' in FIG. 40, it is required that the flat web portion 165 be disposed at a position radially substantially offset from the axis of the shaft 1. This inevitably causes the size of the whole compressor to be increased.

Thus, the elongated slot 166 is disposed at a position corresponding to the locus of movement of the pin 80. In the described embodiment, the length of the elongated slot 166 is so selected that the pin 80 does not contact the ends of the elongated slot 166. Thus, the pin 80 moves along the elongated slot 166 in accordance with movements of the swash plate 10 while the angle of tilt of the swash plate 10 is changed in accordance with movements of the spool 30. The axial movement of the spool 30 is limited by the stopper 305. That is, the tilting angle of the swash plate 10 and the displacement of the pin 80 are limited by the stopper 305. In other words, the movement of the pin 80 within the elongated slot 166 is stopped when the spool 30 is stopped by the stopper 305. In this state, the pin 80 is still spaced from an adjacent end of the elongated slot 166.

For this reason, the described embodiment of the compressor does not require any strict control of the length of the elongated slot 166, provided that the length of the slot is greater than the length of locus of movement of the pin 80.

The compressor also has a shaft seal device 21 which prevents internal fluids such as a refrigerant gas or a lubricating oil from leaking along the surface of the shaft 1. The compressor further has discharge ports 24 which open to the working chambers 50 and 60, respectively, and communicate with discharge chambers 90 and 93, respectively. The discharge ports 24 are adapted to be opened and closed by discharge valves 22 which are fixed together with valve retainers 23 to the front side plate 8 and the rear side plate 11, respectively, by means of bolts which are not shown. The compressor further has suction ports 25 which provide communication between the working chambers 50 and a suction chamber 72 and between the working chambers 60 and a suction chamber 74. These suction ports are opened and closed by suction valves 9 and 12.

Figure 4:
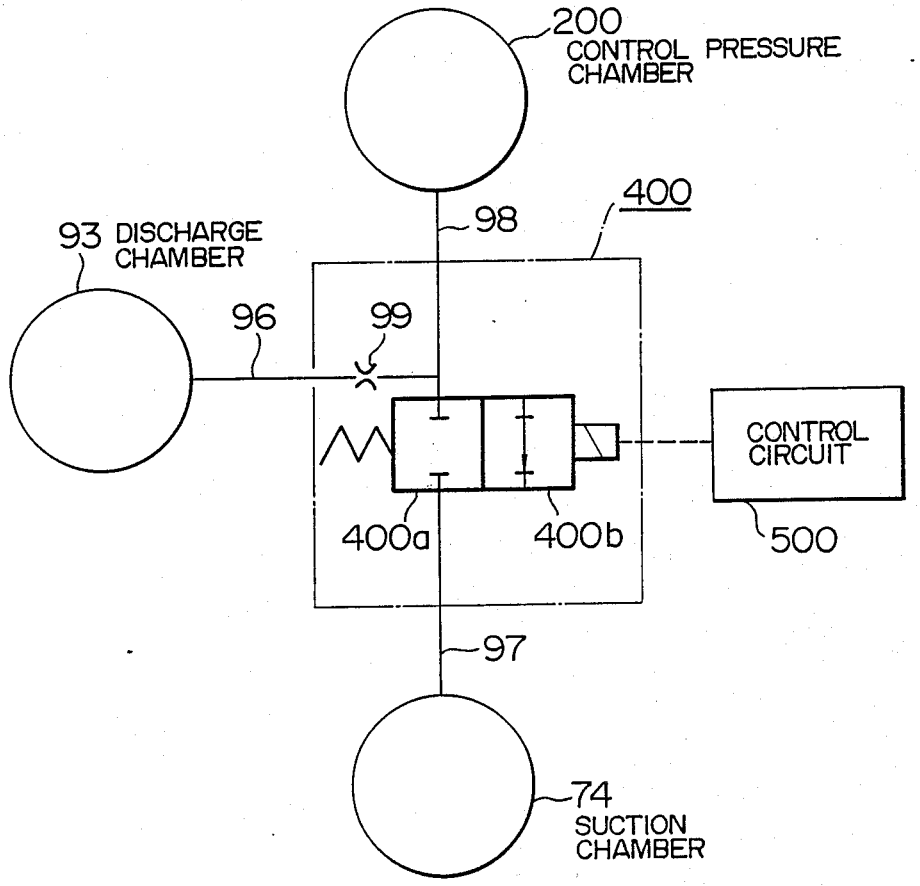
FIG. 4 is a circuit diagram of a solenoid valve incorporated in the compressor shown in FIG. 1.

The compressor also has a solenoid valve 400 which is adapted to control the pressure in a control pressure chamber 200. The solenoid valve 400 is controlled by a control circuit 500. FIG. 4 diagrammatically shows the solenoid valve 400 and elements which are connected to the solenoid valve 400. The solenoid valve 400 is connected at its one end to the suction chamber 74 on the rear side of the compressor through a low-pressure introduction passage 97. The other end of the solenoid valve 400 is connected to the diacharge chamber 93 through an orifice 99 and a high-pressure introduction passage 96 and also to the control pressure chamber 200 through a control pressure passage 98. When the solenoid coil of the solenoid valve 400 is not energized, the valve member of the solenoid valve 400 is set at a position indicated by **400*a* in FIG. 4 and the control pressure chamber 200 is connected to the discharge chamber 93 through the orifice 99**.

Referring again to FIG. 1, the discharge chamber 90 on the front side of the compressor is communicated with a discharge port 92 through a discharge passage 91 formed in the cylinder block 5. The discharge chamber 93 on the rear side of the compressor communicates with a discharge port 95 through a discharge passage 94 formed in the cylinder block 6. The discharge ports 92 and 95 are connected to each other through an external line, so that an equal pressure is maintained in the discharge chambers 90 and 93.

The suction chamber 72 on the front side leads to a suction chamber 70 in a central portion of the housing through a suction passage 71. Similarly, the suction chamber 74 on the rear side of the compressor is connected to the suction chamber 70 via a suction passage 73. Numerals 51, 52, 53, 54, 55 and 56 denote sealing "O" rings.

The operaiton of the described embodiment of the swash-plate type compressor is as follows.

When an electromagnetic clutch (not shown) is energized, the driving torque from an engine (not shown) is transmitted through this clutch to the shaft 1 thereby starting the compressor.

At the same time, a compressor driving signal is input to the controller 500 so that the controller 500 delivers an electric signal to the control valve 400 so as to enable the control valve 400 to bring the low-pressure introduction passage 97 into communication with the control pressure passage 98 which also will be referred to as "signal pressure passage". Thus, the solenoid valve 400 is switched to a indicated by 400*b* in FIG. 4, whereby the pressure in the suction chamber 74 is introduced into the control pressure chamber 200. In this state, there fore, there is no pressure differential across the spool 30, so that no load is applied through the support portion 107 in the direction for tilting the swash plate 10 when the compressor is started.

The shaft starts to rotate in this state so as to drive the swash plate 10 which in turn causes reciprocatory motions of the pistons 7. In consequence, volumes are periodically changed in the working chambers 50 and 60 whereby a refrigerant gas is sucked, compressed and discharged.

During this operation, a force is produced due to the pressure differential between the rear working chamber 60 and the front working chamber 50 across each piston 7. The force is transmitted through the pistons 7 and the associated shoes 18 and 19 to the swash plate 10. The swash plate 10 is rockably supported by the spherical support portion 405 and is adapted to receive the torque from the shaft 1 through the pin 80, so that the force acting on the pistons 7 produces a moment which tends to decrease the angle of tilt of the swash plate 10.

Figure 2:
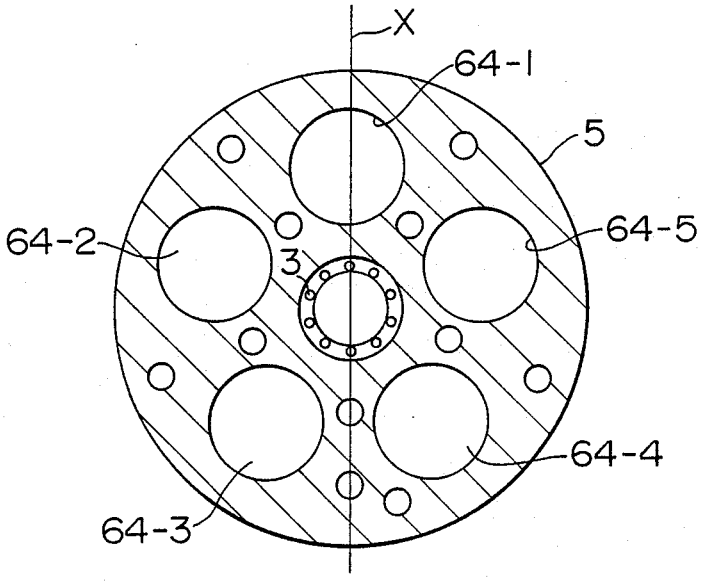
FIG. 2 is a sectional view taken along line II—II in FIG. 1.
Figure 5:
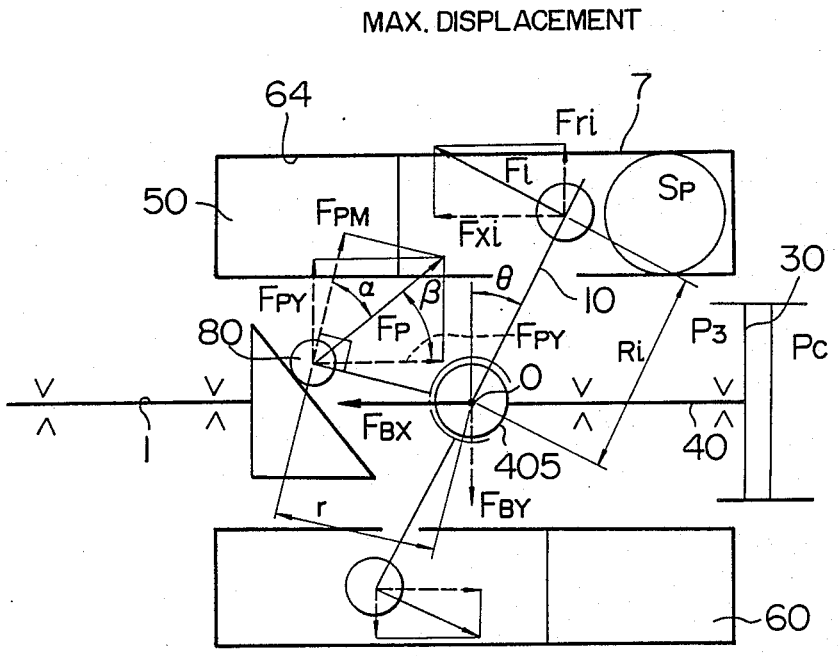
FIG. 5 is an illustration of forces acting on a piston, swash plate and a spool in the compressor shown in FIG. 1.

For instance, referring to FIG. 2, when the pin 80 is positioned on the axis X, the piston disposed in a first cylinder bore 64–1 does not produce any moment which would cause a change in the angle of tilt of the swash plate 10. However, the pistons 7 in second to fifth cylinder bores 64–2, 64–3, 64–4 and 64–5 produce a moment acting in the direction for reducing the tilting angle of the swash plate 10. This moment, represented by $Fi \times Ri$, is born by a moment $F_{PM} \times R$ about the pin 80 (see FIG. 5). Furthermore, the moment produced by the force acting on the pistons 7 produces a force $F_{BX}$ which acts on the spherical support portion 405.

Figure 6:
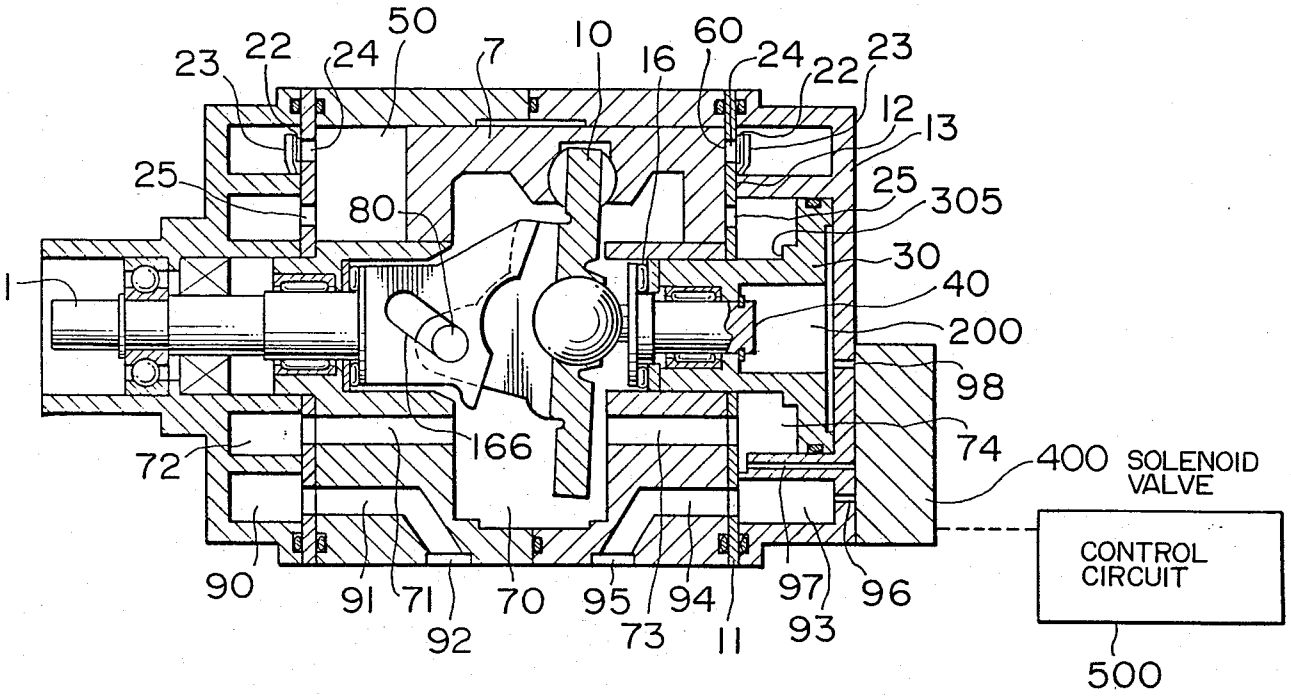
FIG. 6 is an axial sectional view of the compressor shown in FIG. 1, with the swash plate shown as being moved from the position shown in FIG. 1.

Thus, in the state where the control valve transmits suction pressure to the control pressure chamber 200, the spherical support portion 405 and the spool 30 are moved to the right as shown in FIG. 6, thereby reducing the tilting angle of the swash plate 10. Since the movement of the swash plate 10 is limited by the engagement between the pin 80 and the elongated slot 166 in the shaft 1, the swash plate 10 decreases the angle of tilt thereof and at the same time, imparts to the spherical support portion 405 on the center of the swash plate 10 a force which acts rightwards as viewed in FIG. 6 thereby to move the spherical support portion 405 to the right. The rightward force acting on the rear shaft 40 through the spherical support portion 405 is then transmitted through the thrust bearing 16 to the spool 30, so that the spool 30 is displaced until it is stopped by the bottom of the rear housing 13. Thus, the compressor is set for the minimum displacement as shown in FIG. 6.

The refrigerant gas, which is sucked through a suction opening (not shown) connected to an evaporator of a refrigeration cycle, is introduced into the central suction chamber 70 and then introduced into the front and rear suction chambers 72 and 74 through the suction passages 71 and 73. Then, in suction strokes of pistons, the refrigerant is sucked into the working chambers 50 and 60 through the suction valves 9 and 12 and the suction ports 25. The refrigerant gas sucked into the working chambers is then compressed as the pistons associated with these working chambers commence their compression strokes and, when the pressure of the compressed refrigerant gas reaches a predetermined level, it is discharged into the discharge chambers 90 and 93 through the discharge ports 24 while forcibly opening the discharge valves 22. The refrigerant gas compressed to a high pressure is then discharged to a condenser (not shown) of the refrigeration cycle through the discharge passages 91 and 94 and via the discharge ports 92 and 95.

The front working chamber 50 on the front side of the compressor, which also will be referred to as "first working chamber", has a larger dead volume so that the compression ratio in this chamber is smaller than that in the rear working chamber 60 on the rear side of the compressor. The rear working chamber 60 also will be referred to as "second working chamber". In this state, therefore, the pressure of the refrigerant gas in the first working chamber 50 is lower than the pressure in the discharge chamber 90 which communicates with the second working chamber 60, so that suction and discharge of the refrigerant gas are materially not conducted in the first working chamber 50.

Thus, the displacement of the compressor is minimized when the compressor is started. However, as the refrigeration cycle demands a greater displacement of the compressor, the solenoid valve 400 is switched to the state indicated by 400*a* so as to interrupt the communication between the control pressure passage 98 and the low-pressure introduction passage 97. In the described embodiment, the control pressure chamber 200 is communicated with the high-pressure introduction passage 96 through the orifice 99. Therefore, the pressure in the control pressure chamber 200, now disconnected from the low-pressure introduction passage 97, is largely influenced by the discharge pressure transmitted through the high-pressure introduction passage 96. In consequence, the pressure in the control pressure chamber rises.

In consequence, the force which is produced by the pressure differential between the control pressure chamber 200 and the suction chamber 74 and which acts on the spool 30 leftward as viewed in FIG. 6 is progressively increased as the compressor is rotated. When this leftward force is increased to exceed the aforementioned rightward force which acts on the spherical support portion 405, the spool 30 starts to move to the left as viewed in FIG. 1. As a result, the center of rotation of the swash plate 10, i.e., the position of the spherical support portion 405, is progressively moved to the left and the angle of tilt is progressively increased, due to the interaction between the elongated slot 166 and the pin 80. As the internal pressure of the control pressure chamber 200 is increased, the spool 30 moves to the left until its shoulder portion 305 is engaged by the rear side plate 11, thus setting the compressor in the operating state for the maximum displacement as shown in FIG. 1.

When the compressor operates in the state shown in FIG. 1, the refrigerant gas sucked through the suction opening is introduced into the central suction chamber 70 and then into the suction chambers 72 and 74 through the suction passages 71 and 73. The refrigerant gas is then sucked into working chambers 50 and 60 through the suction ports 25 and past the suction valves 9 and 12. The thus sucked refrigerant gas is then compressed as the pistons commence their compression strokes and the compressed refrigerant gas is discharged through the discharge ports 24 and past the discharge valves 22 into the discharge chambers 90 and 93 from which the gas is discharged through the discahrge passage 91 and 94 and the discharge openings 92 and 95. The flow of the compressed refrigerant gas through the discharge opening 92 and the flow of the compressed refrigerant through the discharge opening 95 merge each other in an external line. It will be seen that, in the state shown in FIG. 1, not only the second working chamber 60 but also the first working chamber 50 are operative to effect the suction and discharge of the refrigerant gas.

Figure 7:
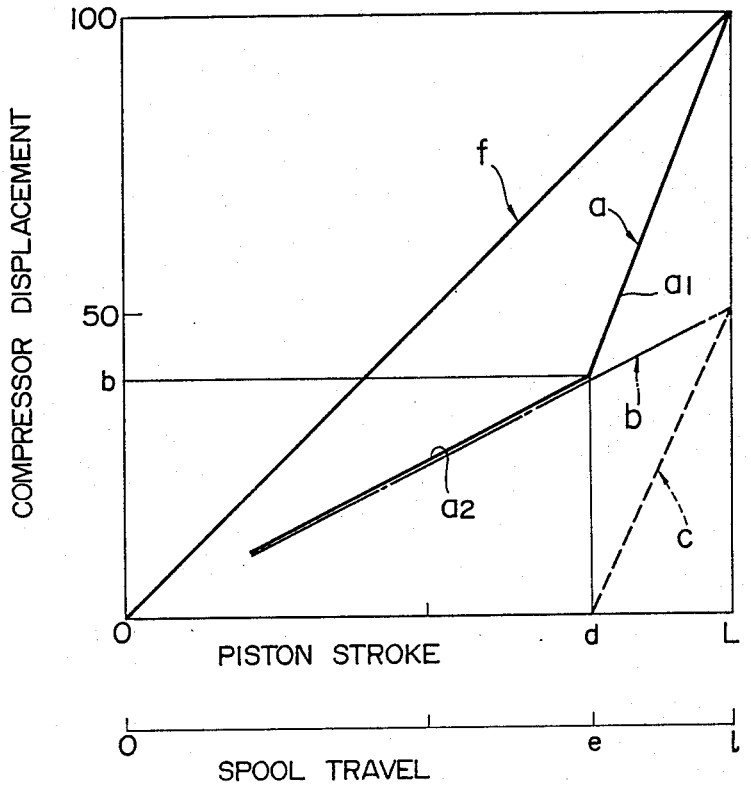
FIG. 7 is a diagram showing the displacement changing characteristic of the compressor shown in FIG. 1.

FIG. 7 is a diagram which shows, by a solid-line curve a, the relationship between the piston stroke and the compressor displacement as observed in a variable displacement swash-plate type compressor in accordance with the present invention.

A change in the tilting angle of the swash plate 10 causes not only a change in the stroke of the pistons 7 but also a change in the position of the center of the swash plate 10, so that there is no substantial increase in the dead volume due to the reduction in the piston stroke in the second working chamber 60. In consequence, the compressor displacement is progressively decreased in accordance with the reduction in the piston stroke, as shown by one-dot-and-dash line b in FIG. 7.

In contrast, in the first working chamber 50, the dead volume is progressively increased in accordance with a reduction in the piston stroke, so that the compression ratio is decreased to cause a drastic reduction in the compressor displacement, as shown by a broken-line c shown in FIG. 7. At a point d shown in FIG. 7, the maximum pressure (discharge pressure) in the front working chamber 50 becomes lower than the discharge pressure of the working chamber 60. In this state, the front working chamber 50 does not contribute to suction and discharge of the refrigerant gas. Namely, the suction, compression and discharge of the refrigerant gas are effected solely by the rear working chamber 60. The piston stroke d at which the working chamber 50 stops the suction and discharge of the gas is given by:

$$P_s\cdot(\pi R^2 L)^k = P_d\cdot\{\pi R^2(L-d)\}^k\, d = L\cdot\{1-(P_s/P_d)^{1/k}\}$$

where

L is maximum piston stroke;

$P_s$ is suction pressure (kg/cm²·abs);

$P_d$ is discharge pressure (kg/cm²·abs);

k is adiabatic index of the refrigerant gas;

R is radius of piston; and $\pi$ is circumference to diameter ratio

The displacement b in this state is given by:

$$b = \frac{1}{2}\cdot\frac{d}{L}\cdot 100\ (\%)$$

On condition of $P_s = 3$ kg/cm² abs, $P_b = 16$ kg/cm² abs and $k = 1.14$, the piston stroke d and the displacement b are respectively calculated as follows:

$$d = 0.77\ L$$

$$b = 38.5\ (\%)$$

The piston stroke is substantially proportional to the amount of movement of the spool 30. Representing the rightward travel end of the spool 30 in FIG. 1 by "0" the leftward travel end by "l", the relationship between the amount of movement of the spool and the displacement of the compressor is shown in FIG. 7. It will be seen that the piston stroke L and the spool travel l meets the condition of $L \alpha l$.

In FIG. 7, the operation characteristic of the compressor in accordance with the present invention is shown by solid-line curve a which has sections $a_1$ and $a_2$ of different gradients. More specifically, when the spool 30 is in a position between l and e, the displacement changes as shown by the section $a_1$ which has a much greater gradient than a curve f representing a linear change in the compressor displacement. Thus, the controllability of the compressor in accordance with the invention is rather inferior when the spool 30 is in the region between l and e, as compared with the case where displacement is linearly changed in accordance with the movement of the spool as shown by the curve f. When the spool is at a position between e and 0, however, the displacement varies along a curve $a_2$ which has a smaller gradient than the curve f, thus enabling the displacement to be controlled more delicately with a high degree of controllability. It will be seen that the compressor of the present invention exhibits superior controllability particularly in the region where the displacement is comparatively small.

When the cooling load is decreased, the control circuit 500 shown in FIG. 4 operates to alternatingly switch the solenoid valve 400 between the positions shown by **400*a* and 400*b* thus effecting, for example, a duty ratio control, thereby progressively decreasing the internal pressure of the control pressure chamber 200 from the level of the discharge pressure, causing the spool 30 shown in FIG. 1 to be progressively moved to the right thereby decreasing the displacement. When it is desired to operate the compressor with minimum displacement, the solenoid valve 400 shown in FIG. 4 is set in the position indicated by 400*b* so as to maintain the suction chamber 74 into communication with the control pressure chamber 200 thereby to reduce the pressure in the chamber 200 to the same level as the suction pressure, whereby the compressor is set for the minimum displacement as shown in FIG. 6**.

The displacement of the compressor is controlled in accordance with the movement of the spool in the manner explained in connection with FIG. 7. An experiment conducted by the inventors, however, has revealed that it is often difficult to hold the spool 30 at a desired position.

Figure 8:
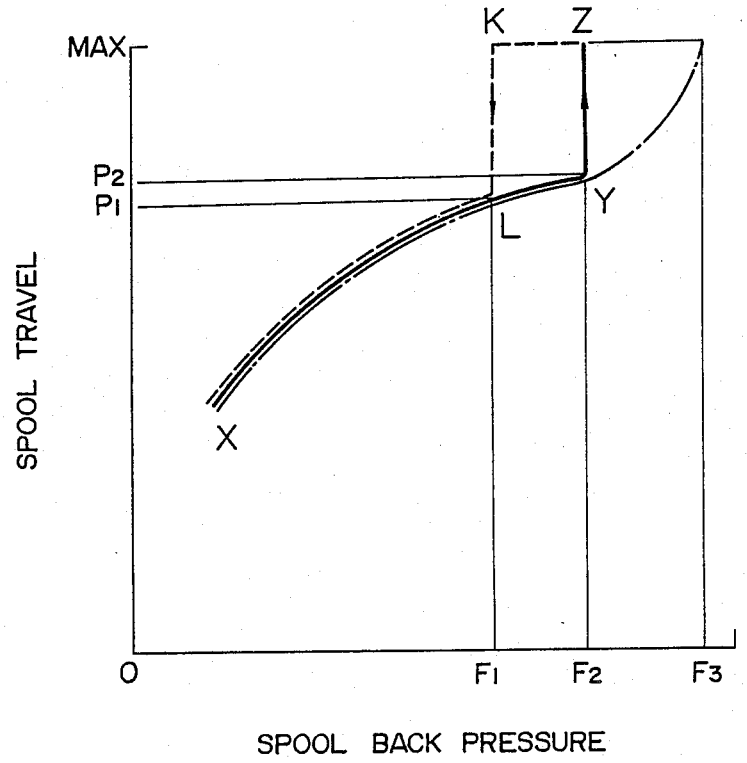
FIG. 8 is a graph showing a relationship between the load produced by back pressure acting on the spool and the amount of movement of the spool.

Referring to FIG. 8, when the back pressure acting on the spool 30 is increased, the spool is moved in accordance with the rise in the back pressure as shown by a solid-line curve X–Y insofar as the back pressure is not higher than a predetermined level $F_2$. In FIG. 8, the axis of ordinate represents the amount of movement of the spool 30 which corresponds to the amount of change in the tilting angle of the swash plate 10 and also to the stroke of reciprocatory motion of the piston 7.

It has been confirmed that, when the back pressure acting on the spool 30 is increased beyond the level $F_2$, the travel of the spool 30 is not increased linearly but is increased to the maximum travel immediately when the pressure level $F_2$ is exceeded, as shown by a solid-line curve Y–Z. Thus, when the back pressure is above the predetermined level $F_2$, the spool 30 is fully moved to its travel and and is held at this position regardless of the level of the back pressure.

Conversely, when the back pressure acting on the spool 30 is decreased, the spool 30 is held at the travel and until the back pressure is decreased from $F_3$ to $F_1$ past the above-mentioned level $F_2$, as shown by a broken-line curve Z–K. When the back pressure comes down below the level $F_1$, the spool 30 is instantaneously moved by a predetermined distance as shown by broken-line curve K–L.

Thus, it has been impossible to delicately control and hold the position of the spool 30 particularly in the region near the travel end of the spool even though the back pressure of the spool 30 is controlled linearly and continuously.

Figure 9:
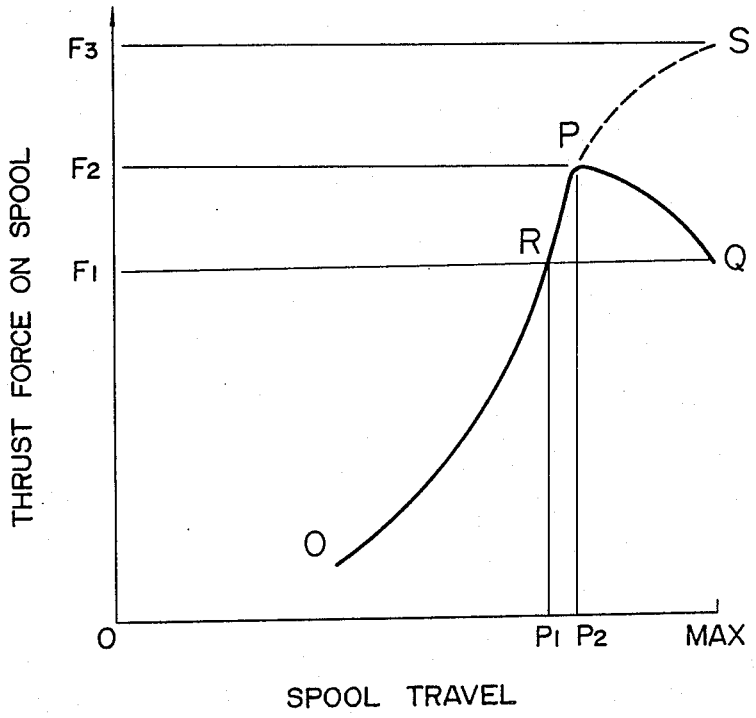
FIG. 9 is a graph showing a relationship between the amount of movement of the spool and the thrust load acting on the spool.

The present inventors have made an intense study for clarifying the cause of this hysteresis in the behavior of the spool in relation to the back pressure and have reached a conclusion that this phenomenon is attributable to the fact that a relationship as shown in FIG. 9 exists between the stroke position of the spool 30 and an axial force exerted by the shaft 1 on the spool 30. In FIG. 9, a symbol O represents a state in which the travel of the spool 30 is minimum so that the tilting angle of the swash plate 10 and, hence, the stroke of the pistons 7 are minimum. As the travel of the spool 30 is increased from the first state shown by O, the stroke of the pistons 7 is increased correspondingly, so that the thrust force which is used for moving the spool 30 is also increased as shown by a solid-line curve O–P in FIG. 9. However, when the travel of the spool 30 is further increased, the force required for moving the spool 30 is not increased but decreased as shown by a solid-line curve P–Q in FIG. 9. The region of operation corresponding to the solid-line curve P-Q is the region where the stroke of reciprocatory motions of the pistons 7 is to be controlled up to the maximum stroke, i.e., the region in which the displacement of the compressor is slightly less than the maximum displacement of the compressor.

Thus, the curve representing the thrust force required for causing the movement of the spool 30 in relation to the travel of the spool between the minimum and maximum travel positions includes a peak or a maximum value $F_2$ of laod at the point P shown in FIG. 9. This maximum load $F_2$ corresponds to the travel position $P_2$ of the spool 30 which in turn corresponds to the point Y in FIG. 8. Thus, the spool 30 is fully moved at once to the maximum stroke position (point Q in FIG. 9 and point Z in FIG. 8) when the thrust force is increased beyond the predetermined value $F_2$. Once this state is reached, the spool 30 is held at this maximum travel position until the back pressure is decreased below the level of the thrust force $F_1$ which is necessary for holding the spool 30 at this maximum stroke position.

When the back pressure acting on the spool 30 comes down below the level of the force $F_1$, the spool 30 is immediately moved from the position represented by the point Q in FIG. 9 to the position indicated by the point R in the same figure. The point R corresponds to the travel position $P_1$ of the spool 30, which in turn corresponds to the point L in FIG. 8.

The characteristic shown in FIG. 9 is attributable to the fact that, in the described swash-plate type compressor of the present invention, dead volume is generated only in the first working chamber 50 when the travel or amount of movement of the spool 30 is small. The operation will be described in more detail hereinunder with specific reference to FIG. 10.

Figure 10:
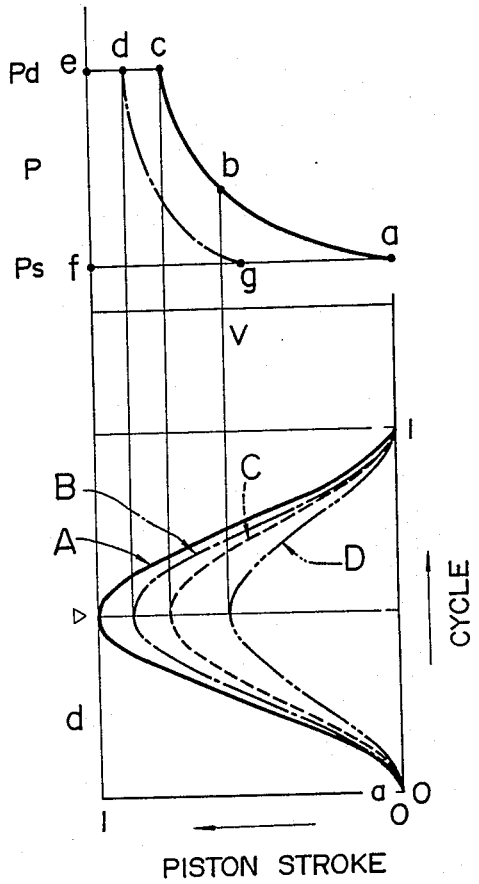
FIG. 10 is a graph illustrating a relationship between the piston stroke and the pressure in working chambers.

FIG. 10 shows a relationship between the stroke of the pistons 7 and the internal pressure of the working chamber 50, i.e., the relationship between the internal volume and the internal pressure of the working chamber 50. In FIG. 10, a solid-line curve A shows a state in which the piston has the maximum stroke, i.e., a state in which the compressor is set for operating with maximum displacement, while a curve B in one-dot-and-dash line shows a state in which the tilting angle of the swash plate has been slightly decreased from the maximum angle to reduce the stroke of the pistons 7. In the state shown by the curve B, therefore, a predetermined dead volume is formed between each piston 7 and the side plate 8. A broken-line curve C in FIG. 10 represents a state in which the tilting angle of the swash plate 10 has been further decreased to further increase the dead volume. A curve D shown by two-dot-and-dash line shows a state in which the tilting angle of the swash plate 10 has been minimized to minimize the stroke of each piston 7 and, hence, maximize the dead volume.

Referring first to the curve A showing the state in which the pistons 7 are each allowed to fully move to the maximum stroke end position, the internal volume of the working chamber 50 is decreased as the piston 7 moves from the fully retracted position a so that the internal pressure of the working chamber 50 is increased as shown by a curve a–b–c. When the pressure reaches a predetermined discharge pressure $P_d$, the discharge valve 24 is opened to relieve the compressed gas so that the internal pressure of the working chamber 50 does not increase any more. Thus, the pressure in the working chamber is maintained at the level of the predetermined discharge pressure $P_d$, as shown by a straight line c–d–e. The piston 7 then reaches the stroke end represented by e and then commences its backward stroke. In consequence, the suction port 25 is opened to cause the internal pressure of the working chamber 50 to be reduced immediately down to the level of the suction pressure $P_s$ which is indicated by f in FIG. 10. The piston then returns to the fully retracted position shown by a. Thus, the pressure in the working chamber 50 changes following the curves a–c–e–f–a when the stroke of each piston is maximized.

When the tilting angle of the swash plate 10 has been slightly decreased, a slight dead volume is formed in the working chamber 50 so that a certain volume of compressed gas remains in the working chamber before the piston 7 commences its backward stroke. In consequence, when the piston moves backward, the compressed refrigerant gas ramaining in the working chamber 50 is allowed to expand, as shown by one-dot-and-dash line d–g, so that the pressure in the working chamber 50 is maintained at a level above the suction pressure $P_s$.

When the tilting angle of the swash plate 10 is further decreased, the stroke of the piston 7 is also decreased to allow a large dead volume to be formed in the working chamber 50. In this case, the pressure of the gas compressed in this working chamber 50 cannot reach the predetermined discharge pressure $P_d$ so that the discharge valve 24 is never opened. This state is shown by the broken-line curve C in FIG. 10. The pressure in the working chamber is increased along the curve a–b–c and then decreased along the curve c–b–a.

When the tilting angle of the swash plate 10 is further decreased to further reduce the stroke of the piston 7, each piston 7 moves along the two-dot-and-dash line curve D in FIG. 10. In this case, the refrigerant gas is not sucked into nor discharged from the working chamber 50, so that the pressure in the working chamber 50 merely increased along the curve b–a and decreased along the curve b–a.

It will be seen, accordingly, that the pressure in the working chamber 50 is varied by the formation of a dead space in the working chamber 50.

Figure 11:
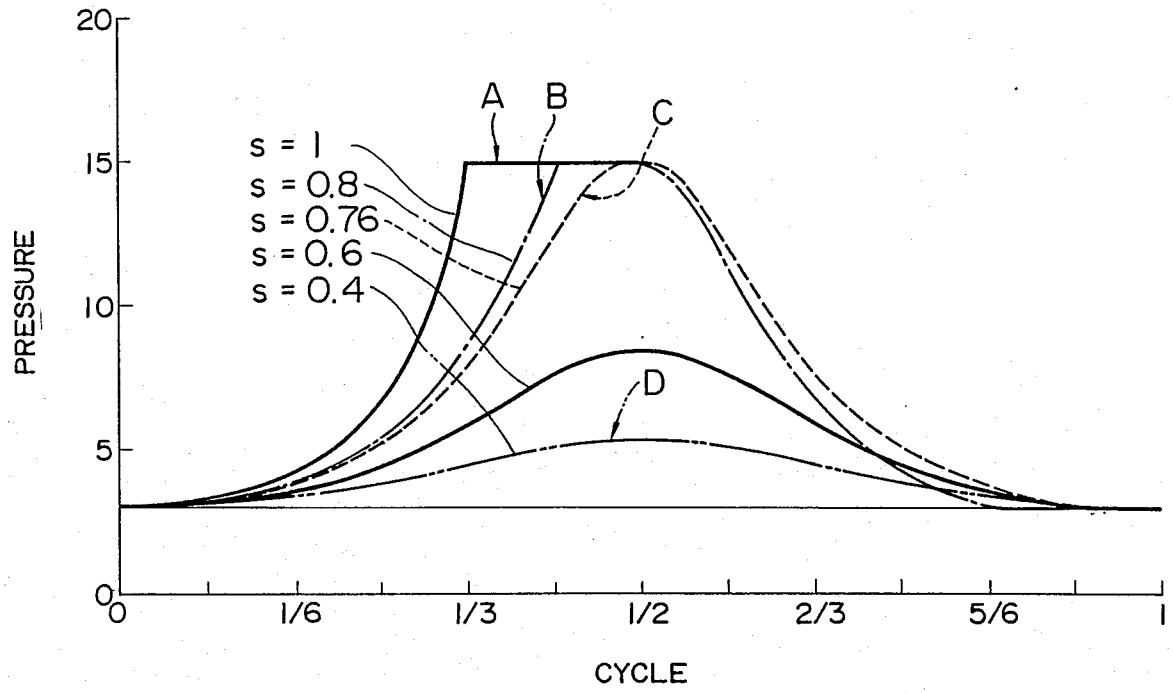
FIG. 11 is a graph showing a relationship between the reciprocatory motion of a piston and pressures in working chambers.

FIG. 11 is a graph showing a relationship between the pressure in the working chamber 50 and the cycle of reciprocation of the piston 7. A solid-line curve A corresponds to the state shown by the solid-line curve A in FIG. 10. In this state, no dead space is formed on the end of each piston 7 so that the pressure in the working chamber 50 is lowered to the level of the suction pressure $P_s$ without delay after the commencement of backward stroke of the piston 7. A one-dot-and-dash line curve B in FIG. 11 shows a state corresponding to the state represented by the one-dot-and-dash line curve B in FIG. 10. In this state, a certain dead volume is formed in the working chamber 50 so that there is a residual pressure in the working chamber 50 due to the presence of the dead volume. Namely, the pressure in the working chamber 50 is not lowered immediately to the level of the suction pressure after the piston 7 has commenced its backward stroke. More specifically, the pressure in the working chamber 50 is progressively decreased from the level of the discharge pressure $P_d$ to the level of the suction pressure $P_s$. A broken-line curve C in FIG. 11 corresponds to the state shown by the broken-line curve C in FIG. 10. In this state, the dead volume is so large that the pressure in the working chamber 50 varies along a sine wave curve and the pressure in the working chamber 50 is not lowered below the level of the suction pressure $P_s$.

A curve D in two-dot-and-dash line in FIG. 11 corresponds to the state represented by the two-dot-and-dash line D in FIG. 10. In this state, the pressure in the working chamber 50 changes along a sine wave curve, but neither suction nor discharge of the refrigerant gas is conducted as in the case of the state shown by the curve C. In the state shown by the curve D, moreover, the pressure variation in the working chamber is decreased and the maximum pressure in the working chamber 50 is decreased.

The region between the points P and Q in FIG. 9 corresponds to the region between the solid-line curve A and the broken-line curve C in FIG. 10. As will be understood from FIG. 11, in this region, the pressure in the working chamber 50 produces a force which acts to urge the piston 7 to the right as viewed in FIG. 1.

This rightward urging force acting on the piston 7, produced by the pressure in the first working chamber 50, serves to increase the tilting angle of the swash plate 50. Namely, the tilting angle of the swash plate 10 is increased due to the residual pressure in the working chamber 50 to increase the stroke of reciprocatory motion of the piston 7. The behavior of the piston 7 and the swash plate explained above is conducted in the region between the points P and Q in FIG. 9. In this region, the pressure remaining in the working chamber 50 is increased as the dead volume increases. In consequence, the thrust force required for urging the spool 30 to the left as viewed in FIG. 1 is increased as the dead volume is increased.

The foregoing description taken in conjunction with FIGS. 9 to 11 is based on an assumption that the suction pressure $P_s$ and the discharge pressure $P_d$ are constant. When the compressor is used for the purpose of compressing a refrigerant gas in a refrigeration cycle, however, both the suction pressure $P_s$ and the discharge pressure $P_d$ vary in accordance with a varying condition of operation of the refrigeration cycle. For instance, when the refrigeration cycle operates under a comparatively light load, the suction pressure $P_s$ and the discharge pressure $P_d$ are, for example, 2.5 kg/cm$^2$ abs and 16 kg/cm$^2$ abs, respectively. However, when the thermal load applied to the refrigeration cycle is increased, the suction pressure $P_s$ and the discharge pressure $P_d$ are increased to, for example, 4 kg/cm$^2$ abs and 26 kg/cm$^2$ abs, respectively. The change in the suction and discharge pressures $P_s$ and $P_d$ also causes a change in the compression ratio $\epsilon$.

Figure 12:
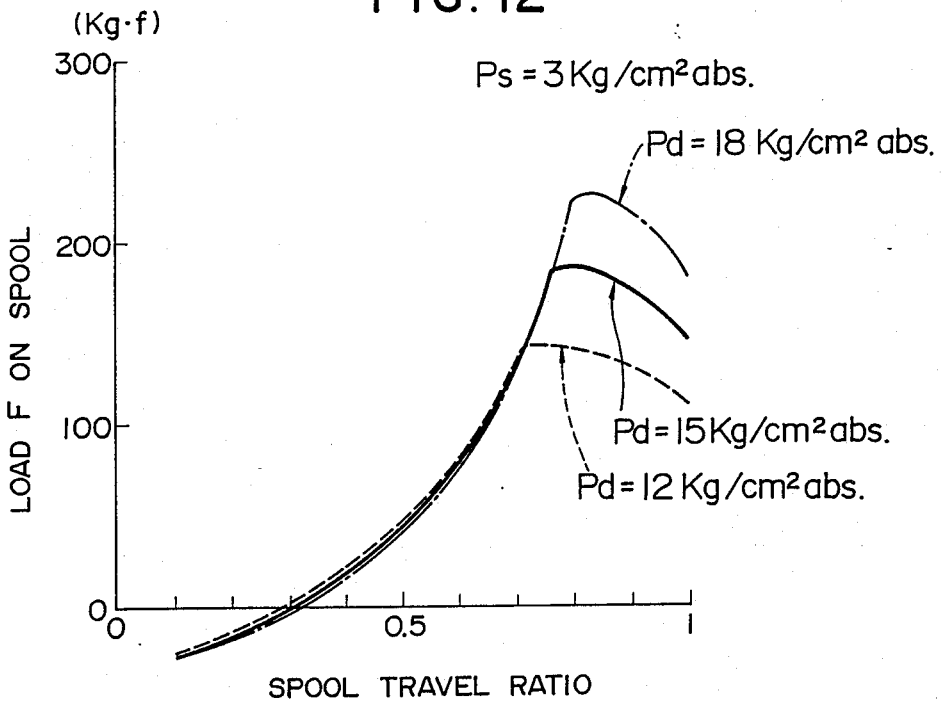
FIG. 12 is a graph showing a relationship between the stroke ratio of a spool and the thrust load acting on the spool.
Figure 13:
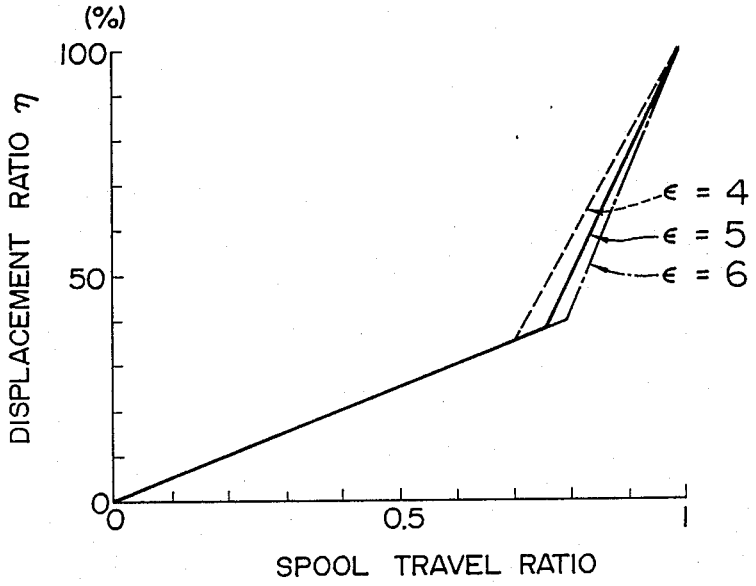
FIG. 13 is a graph showing a relationship between piston stroke ratio and displacement ratio of the compressor.

FIG. 12 shows the change in the thrust load required fro axially moving the spool 30 of the compressor in relation to a change in the discharge pressure $P_d$. As will be seen from FIG. 12, the thrust load is increased as the discharge pressure becomes higher. It will also be seen that the thrust load varies largely particularly in the region immediately after the dead volume starts to be generated on the end of the piston 7. This is because the residual pressure generated due to the presence of the dead space produces a force which acts to force the spool 30 backward through the piston 7 and the swash plate 10. Namely, in the state where the discharge pressure is high, the residual pressure generated in the working chamber 50 due to the presence of the dead volume becomes higher, requiring a greater thrust load for axially moving the spool 30. As will be seen from FIG. 12, when the dead volume is increased beyond a predetermined value, the discharge pressure no longer affects the internal pressure of the working chamber 50. This means that, when the spool 30 has been moved to a predetermined position, the thrust load required for any further axial movement of the spool 30 is maintained constant regardless of any change in the discharge pressure. In consequence, the relationship shown in FIG. 7 between the travel of the spool and the displacement of the compressor varies in accordance with the change in the suction pressure $P_s$ and the discharge pressure $P_d$ as shown in FIG. 13. In FIG. 13, the solid-line curve shows the state in which the compressor operates steadily with a compression ratio of 5.0. The broken-line curve and the one-dot-and-dash line curve show, respectively, the states of operation of the compressor under a light load (compression ratio =4.0) and under a heavy load (compression ratio =6.0).

As will be understood from the foregoing description, the thrust load required for causing axial movement of the spool 30 from the position corresponding to the point $P_2$ (see FIG. 9) to the maximum stroke position is so influenced by the internal pressure of the working chamber 50 that the thrust load decreases as the spool 30 approaches the maximum stroke position. Thus, a non-linear relationship as shown in FIG. 9 is established between the travel of the spool 30 and the axial thrust force required for moving the spool 30. Under such a non-linear relationship, it is impossible to accurately control the displacement of the compressor solely by the control of the pressure in the control pressure chamber 200. In order to continuously control the displacement of the compressor, therefore, it is necessary to obtain such an operation characteristic as represented by a curve P–S in FIG. 9. To cope with this demand, the described embodiment of the swash-plate type compressor of the present invention employs an auxiliary loading means such as a biasing spring 900 (see FIG. 14) for biasing the spool 30 in the direction for reducing the displacement. Thus, the descending slope of the characteristic curve in the region between the points P and Q in FIG. 9 is changed by the auxiliary loading means into ascending slope as shown by broken-line curve P–S therein.

The biasing spring 900 is designed to be effective only when the travel of the spool 30 reaches a range between the point $P_2$, at which the thrust force shown in FIG. 9 is maximized, and the maximum stroke position MAX in FIG. 9. The spring constant of the biasing spring 900 is so selected as to be large enough to compensate for the decreasing tendency of the thrust load in the region P–Q in FIG. 9.

Figure 14:
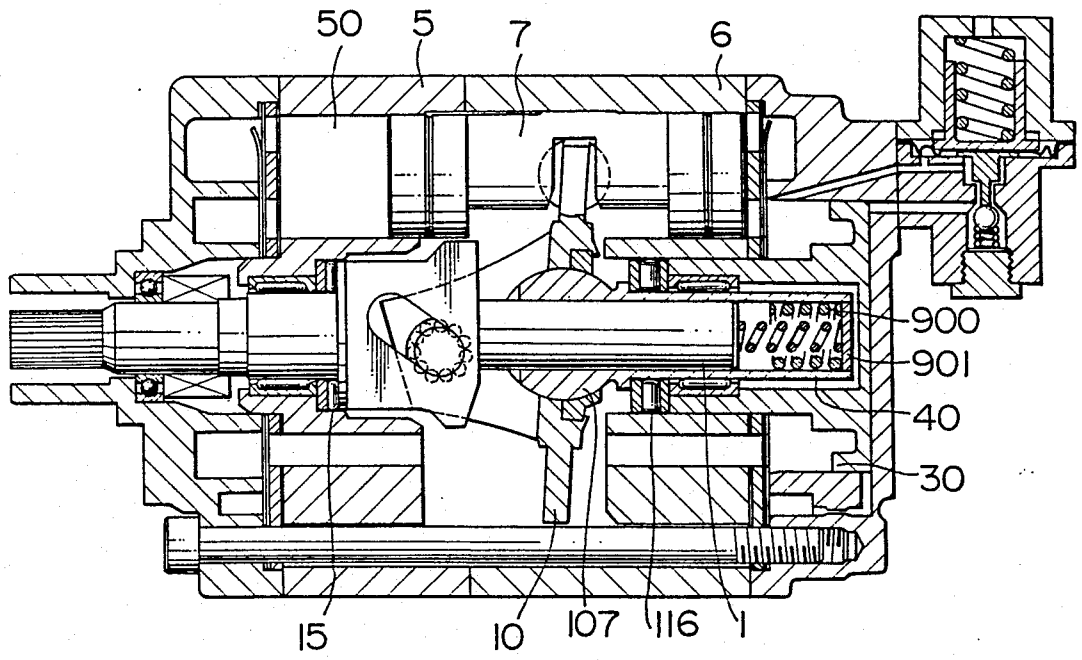
FIG. 14 is an axial sectional view of another embodiment of the swash-plate type compressor in accordance with the present invention.

FIG. 14 shows a swash-plate type compressor in accordance with the present invention. It is assumed that the stroke of the spool 30 corresponding to the maximum tilting angle of the swash plate 10 is 0 mm, while the maximum stroke of the spool 30 corresponding to the minimum tilting angle of the swash plate 10 is 10 mm. When the spool 30 is positioned in the maximum stroke position, the stroke of the reciprocatory motion of the piston 7 is 20 mm. Assuming here that the maximum volume of the compressor is 180 cc and that the suction pressure $P_s$ is 3 kg/cm$^2$ abs while the discharge pressure $P_d$ ranges between 12 kg/cm$^2$ abs and 18 kg/cm$^2$ abs, the change in the gradient of the characteristic curve in FIG. 12 from positive to negative gradient takes place when the travel of the spool 30 is 7 mm or greater. In the embodiment shown in FIG. 14, therefore, the biasing spring 900 is designed to apply a load when the stroke of the spool 30 has become 7 mm or greater. In such a case, the spring constant of the biasing spring 900 is, for example, 33 kg/mm.

Figure 15:
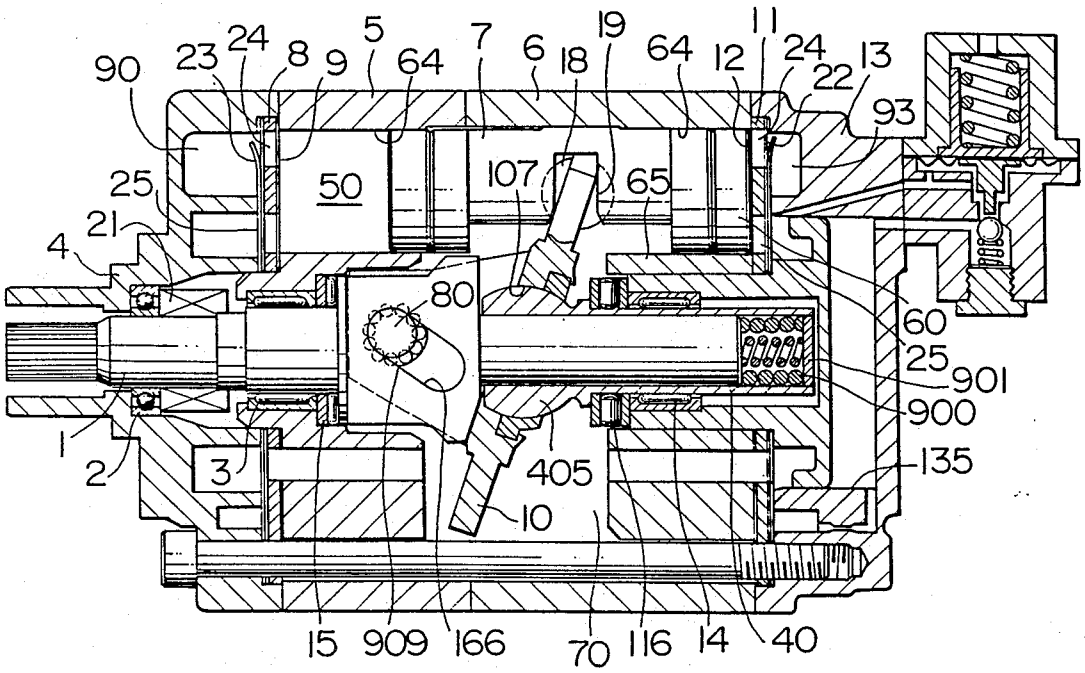
FIG. 15 is a sectional view of the compressor shown in FIG. 14 with the compressor shown in a different state of operation.

The provision of the biasing spring 900 as the auxiliary loading means produces the following effect:

When the travel of the spool 30 is between 0 mm and 7 mm, the thrust load required for moving the spool 30 varies along a curve OP in FIG. 9, so that the travel of the spool 30 is increased substantially linearly in accordance with an increase in the back pressure acting on the spool 30. When the stroke of the spool 30 is increased beyond 7 mm, the biasing spring 900 becomes effective. In this state, the spool 30 cannot be moved reightwards as viewed in FIG. 14 unless a thrust load exceeding the load of the biasing spring 900 is applied to the rear side of the spool 30. Thus, the thrust force required for moving the spool 30 is increased along the curve P–S rather than being decreased along the curve P–Q. FIG. 15 shows the state in which the spool 30 has been moved in excess of 7 mm to commence a compression of the biasing spring 900.

From the foregoing description, it will be seen that the provision of the biasing spring 900 eliminates the reversed tendency of the travel of the spool 30 relative to the thrust load which is caused due to a dead volume in the working chamber 50.

In the embodiment shown in FIGS. 14 and 15, the biasing spring 900 is a coiled spring disposed between one end of the shaft 1 and a retainer plate 901 provided on one end of the rear shaft 40. The shaft 1 is prevented by the thrust bearing 15 from being moved axially. The rear shaft 40 slidably fits on the shaft 1 and is connected to the spool 30 through a thrust bearing 116 so as to be able to move as a unit with the spool 30. Therefore, a leftward movement of the spool 30 as viewed in FIG. 14 is transmitted through the thrust bearing 116 to the rear shaft 40 and, hence, to the spherical portion 107. In consequence, the retainer plate 901 on the rear shaft 40 is also displaced and the end of the biasing spring adjacent to the shaft 1 is brought into contact with the shaft 1 when the travel of the spool 30 has reached 7 mm so that the biasing spring 900 begins to exert a pressing load on the spool 30 as shown in FIG. 15.

In the embodiment shown in FIGS. 14 and 15, the shaft 1 extends through the swash plate 10 into the rear housing 6 and is supported at axially spaced points by a rear bearing 14 and a front bearing 3. Thus, the shaft 1 is stably supported for smooth rotation. It is also to be noted that the pin 80 is supported in the pin-receiving holes 106 and 108 in the walls defining the slit 105 through the intermediary of bearings 909. Therefore, the operation for changing the tilting angle of the swash plate 10 by an axial movement of the spool 30 encounters only a small friction resistance produced around the pin 80. In consequence, the movement of the spool 30 is smoothly converted into a change in the tilting angle of the swash plate 10 so that the compressor exhibits a highly continuous change in the displacement in accordance with the change in the tilting angle of the swash plate 10.

Although the biasing spring 90 is disposed on the rear end of the shaft 1 in the embodiment shown in FIGS. 14 and 15, this is not exclusive and the biasing spring 900 may be disposed at any other portion provided that it becomes effective only when the spool 30 has been moved beyond a predetermined stroke.

Figure 16:
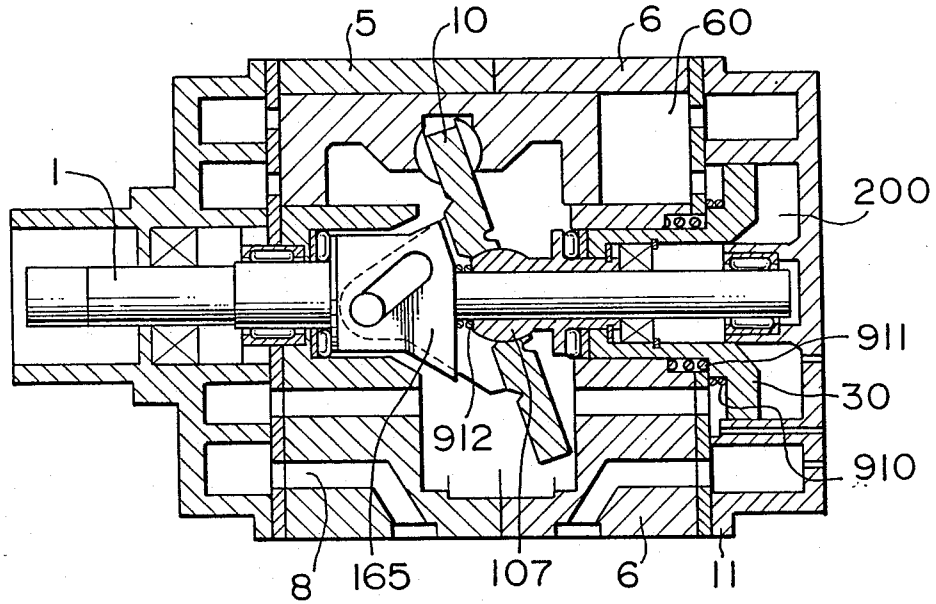
FIG. 16 is an axial sectional view of another embodiment of the swash-plate type compressor in accordance with the present invention.

FIG. 16 shows different examples of the arrangement of the biasing spring as the auxiliary loading means. A biasing spring 910 may be disposed between the spool 30 and the rear end plate 11. Alternatively, a biasing spring 911 may be disposed between the spool 30 and the rear housing 6. Further alternatively, a spring 912 may be disposed between the spherical support portion 107 and the portion 165 formed on the shaft 1.

In the described embodiment of the present invention, a return spring is used as the auxiliary loading means to compensate for the reduction in the thrust force required for displacing the spool which occurs when the travel of the spool has exceeded a certain value. It will be clear to those skilled in the art, however, the use of the return spring is not exclusive and other means such as pressure means may be used as the auxiliary loading means. It will also be understood that, even when a biasing spring is used as the auxiliary loading means, the spring may have a non-linear characteristic.

As will be understood from the foregoing descriptin, since the swash-plate type compressor of the present invention is provided with the auxiliary loading means which becomes effective when the stroke of the spool has been increased beyond a predetermined value, the travel of the spool 30 can be smoothly and substantially linearly controlled up to the maximum travel by a continuous control of the pressure in the control pressure chamber.

According to experiments and studies made by the present inventors, however, it has been known that the control of the travel of the spool through the control of the pressure in the control pressure chamber 200 tends to become unstable particularly in the region where the stroke of the spool 30 is small. More specifically, in such a region of small stroke of the spool the spool cannot be moved smoothly in response to a reduction in the pressure in the control pressure chamber 200.

This is attributable to the fact that, as will be seen from FIG. 12, the thrust load required for causing the leftward movement of the spool 30 as viewed in FIG. 1 takes a negative value when the amount of travel of the spool 30 is between 0 and 3 mm while the maximum stroke is 10 mm.

When the travel of the spool 30 is near the minimum value, the level of the residual pressure in the first working chamber 50 is low as shown by two-dot-and-dash line in FIG. 11. On the other hand, in the second working chamber 60, the pressure changes between the levels of the suction pressure and the discharge pressure in accordance with reciprocal movements of the piston 7 because no dead volume is formed in this working chamber 60. Thus, the pressure in the second working chamber 60 can rise up to the level of the discharge pressure $P_d$ even when the compressor is in the region near the minimum spool travel.

Figure 17:
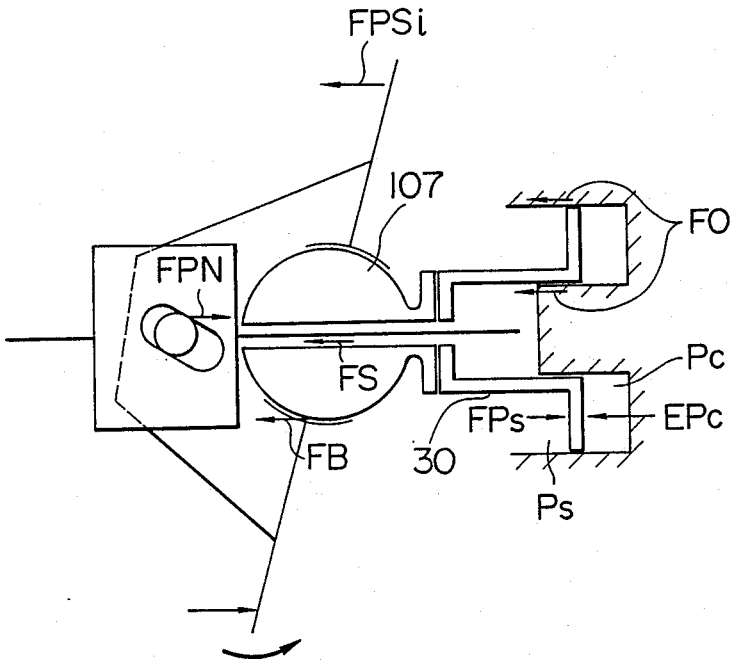
FIG. 17 is an illustration of the thrust load applied to a spool in the compressor shwon in FIG. 16.

A detailed description will be made hereinunder as to the change in the thrust load required for axially displacing the spool 30 when the travel of the spool 30 is small. FIG. 17 shows the state of load applied to the spool 30 when the stroke of the spool 30 is small. In this figure, FPSi represents the sum of the pressing forces exerted to the swash plate 10 by pistons 7 in the compression phase, while FPN represents a force which acts on the pin 80. $P_s$ and $P_c$ represent, respectively, the pressure in the suction chamber 74 and the pressure in the control pressure chamber 200. The thrust loads produced by the pressures $P_s$ and $P_c$ are represented by $FP_s$ and $FP_c$, respectively. A frictional force between the spherical support portion 107 and the swash plate 100 is represented by FB, while frictional forces between the shaft 1 and the rear shaft 40 and between the spool 30 and the inner surface of the housing 135 are represented by FS and FO, respectively.

As will be seen from FIG. 17, when the compressor is operating with a certain level of displacement with the spool 30 set at a certain travel position, the following condition has to be met if the spool 30 is to be moved toward the minimum stroke position, i.e., to the right as viewed in FIG. 17:

$$FPS_i + FP_s > FPN + FPC + FB + FS + FO$$

When the displacement of the compressor is small, there is no substantial pressure rise in the first working chamber 30 while the pressure in the second working chamber 60 can rise to the level of the discharge pressure. Thus, the value of the force $FPS_i$ is too small to satisfy the condition shown by the above inequality, thus making it impossible to reduce the compressor displacement.

In order that the above-mentioned condition may be met, it is necessary that the value of the first term FPN of the right side of the inequality be reduced or, alternatively, the value of the first term $FSP_i$ of the left side of the inequality be increased.

The force FPN, however, is produced by the pressure differential between the suction chamber 74 and the control pressure chamber 200 and, therefore, it is difficult to reduce this value from the view point of the mechanical construction. Namely, it is difficult to reduce the pressure $P_c$ in the control pressure chamber 200 to a level below the suction pressure $P_s$. There also is a practical limit in the reduction of the mechanical frictional forces FB, FS and FO because there is a limit in reducing the friction coefficients of component parts.

Figure 18:
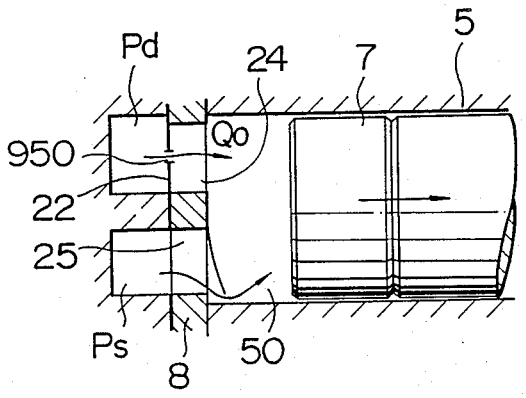
FIG. 18 is a sectional view of an essential portion of the compressor in accordance with the present invention.

The present inventors, therefore, have reached a conclusion that it will be a practical measure to increase the value of the force $FPS_i$ for the purpose of enabling the spool 30 to the minimum stroke position without fail. In order to increase the value of the force FPSi, there are two methods one of which is to increase the pressure in the first working chamber 50 and the other method is to decrease the pressure in the second working chamber 60. The present invention also proposed an auxiliary for assuring a minimum spool travel. In an embodiment of the invention, this auxiliary means is constituted by a boosting passage means which provides a communication between the first working chamber 50 and the exterior. In an embodiment shown in FIG. 18, the boosting passage means comprises a boosting port 950 formed in the discharge valve 22. The boosting port is a minute port orifice which has a very small diameter of about 0.2 mm and is adapted for allowing a very small quantity of $Q_O$ of the refrigerant gas at the discahrge pressure to be returned into the first working chamber 50. It will be seen that the level of the pressure in the first working chamber 50 is elevated as a result of the returning the compressed refrigerant gas into this chamber 50.

Figure 19:
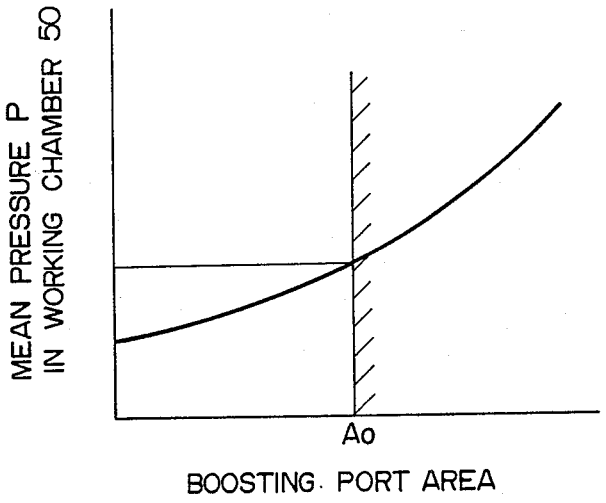
FIG. 19 is a graph showing a relationship between the opening area of a relief port shown in FIG. 18 and the mean pressure in a pressure chamber.

FIG. 19 shows how the mean pressure P in the first working chamber 50 is varied in relation to a change in the area of opening of the boosting port 950. As will be seen from this figure, the pressure in the first working chamber 50 is increased as the opening area of the boosting port 950 is increased. In order to obtain a value of the mean pressure P which is large enough to enable the force $FPS_i$ to meet the condition of the inequality mentioned before, it is sufficient to determine the opening area of the boosting port 950 to be greater than $A_O$.

Figure 20:
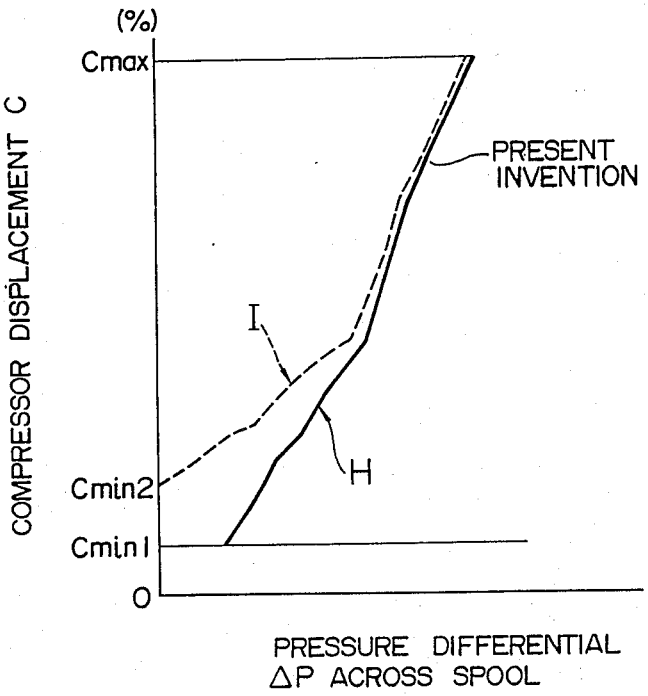
FIG. 20 is a graph showing a relationship between the pressure difference across the spool and the displacement of the compressor.

The displacement C of the compressor was measured in relation to the pressure differential $\Delta P$ across the spool 30 in a compressor having the boosting port of an opening area greater than $A_O$, the result being shown by a solid-line curve H in FIG. 20. The pressure differential $\Delta P$ across the spool 30 is the difference between the suction pressure in the suction chambers 73 and 74 and the control pressure $P_c$ in the control pressure chamber 200. From FIG. 20, it will be seen that the pressure differential $\Delta P$ across the spool 30 is reduced as a result of provision of the boosting port 950 to ensure that the spool 30 can be fully moved to the minimum travel position thereby enabling the compressor to reduce its displacement to the minimum value. For the purpose of comparison, a broken-line I in FIG. 20 shows the relationship between the pressure differential across the spool 30 and the displacement C observed in a compressor which is not provided with the boosting port 950.

Figure 21:
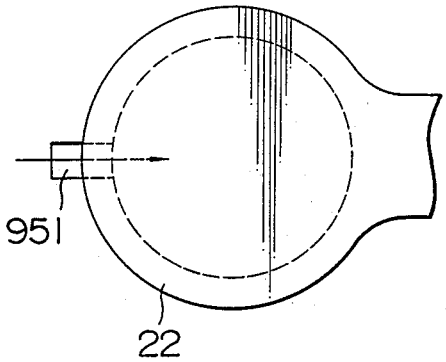
FIG. 21 is a front elevational view of a further embodiment of the swash-plate type compressor of the present invention, illustrating an essential portion of this embodiment.
Figure 22:
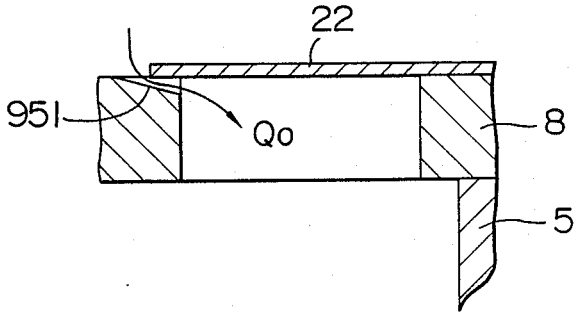
FIG. 22 is a sectional view of the embodiment shown in FIG. 21.

The auxiliary biasing means can be in other forms than the described boosting port 950, e.g., in the form of a pressure boosting passage means. For instance, in an embodiment shown in FIGS. 21 and 22 employs, the auxiliary biasing means is in the form of a boosting groove 951 which biases the end plate 8 and the discharge valve 22. This boosting groove 951 is advantageous over the boosting port 950 in that it is less liable to be clogged by foreign matters.

Figure 23:
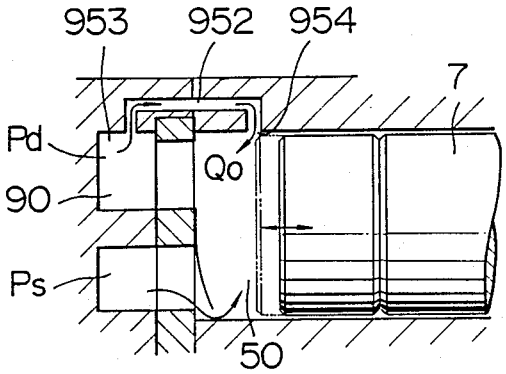
FIG. 23 is a sectional view of a still further embodiment of the swash-plate type compressor of the present invention, showing particularly an essential part thereof.

In an embodiment shown in FIG. 23, the auxiliary biasing means is constituted by communicating passage 952 which opens at its one end in the discharge chamber 90 and at its other end in the portion of the first working chamber 50 adjacent to the top dead center of the piston 7 (shown by a broken line). It will be understood that this communicating passage 952 effectively increases the pressure in the first working chamber 50 by introducing a high pressure from the discharge chamber 90. This communicating passage 952 can have a comparatively large diameter because the open end 954 thereof can be covered by the side surface of the piston 7 during normal operation of the compressor.

The auxiliary biasing means in the described embodiments is intended to increase the mean pressure in the first working chamber 50 by introducing thereinto a high pressure available in the discharge chamber 90. This, however, is not exclusive and the auxiliary biasing means may be constituted by other types of means.

Figure 24:
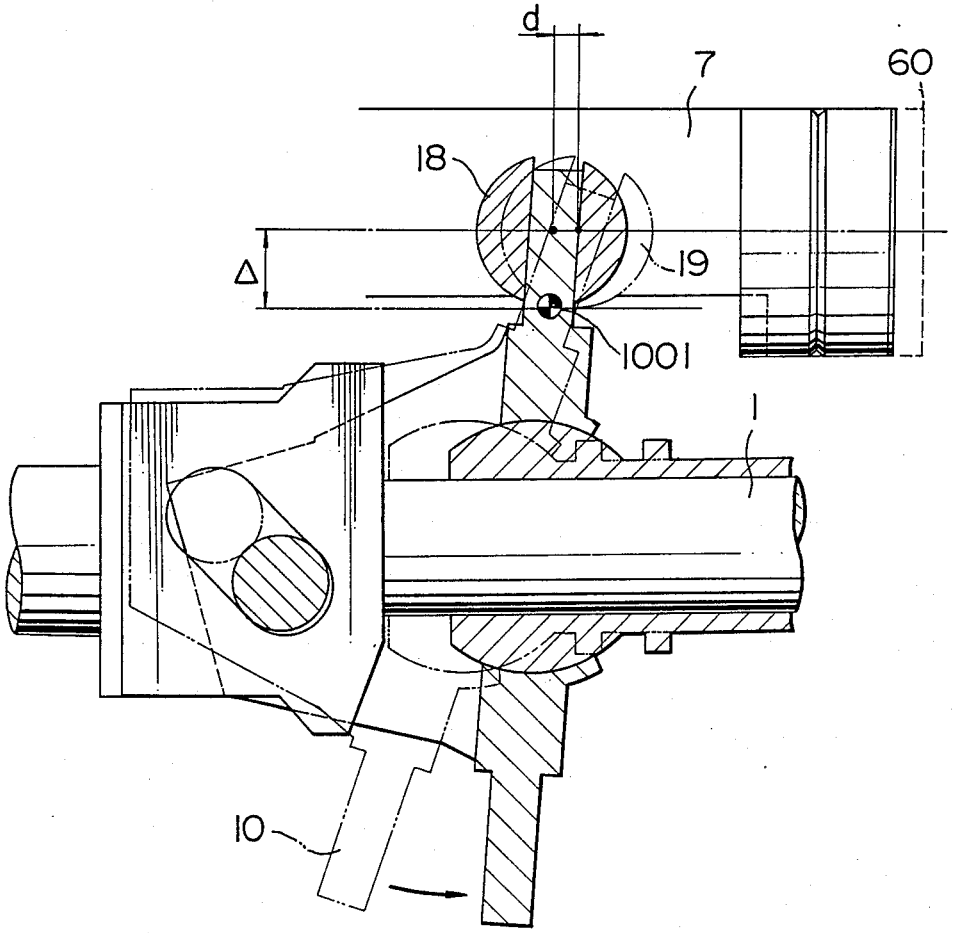
FIG. 24 is a sectional view of a still further embodiment of the swash-plate type compressor of the present invention, showing particularly an essential part thereof.
Figure 38:
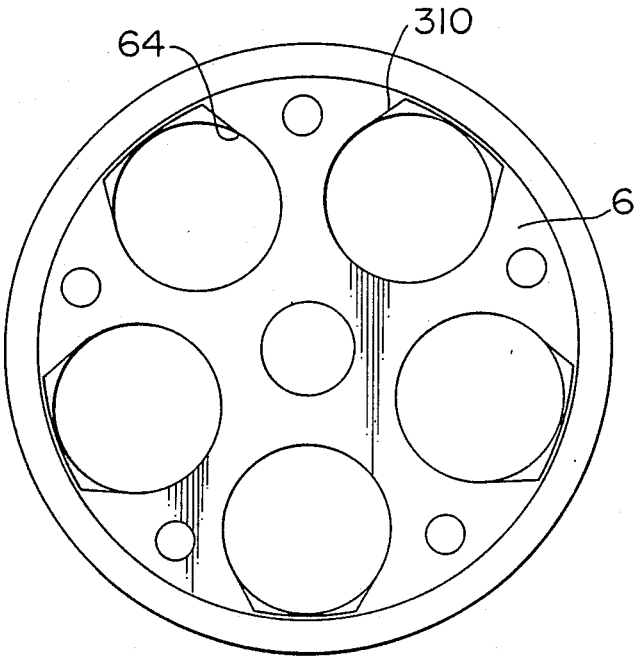
FIG. 38 is an end view of a cylinder block.

FIG. 24 shows an embodiment which employs another type of auxiliary biasing means. More specifically, in this embodiment, a dead space is formed also in the second variable volume chamber 60. Namely, an apparent hinge point 1001 of the swash plate 10 is offset from the center of the shoes 18 and 19 towards the shaft 1, as shown in FIGS. 38 and 38, so that, when the tilting angle of the swash plate 10 has been decreased, the center of the shoes 18 and 19 is slightly displaced to the left as viewed in FIG. 24. For the reason explained before in connection with FIG. 11, the provision of this small dead volume increases the mean pressure in the second, variable volume chamber 60.

Figure 25:
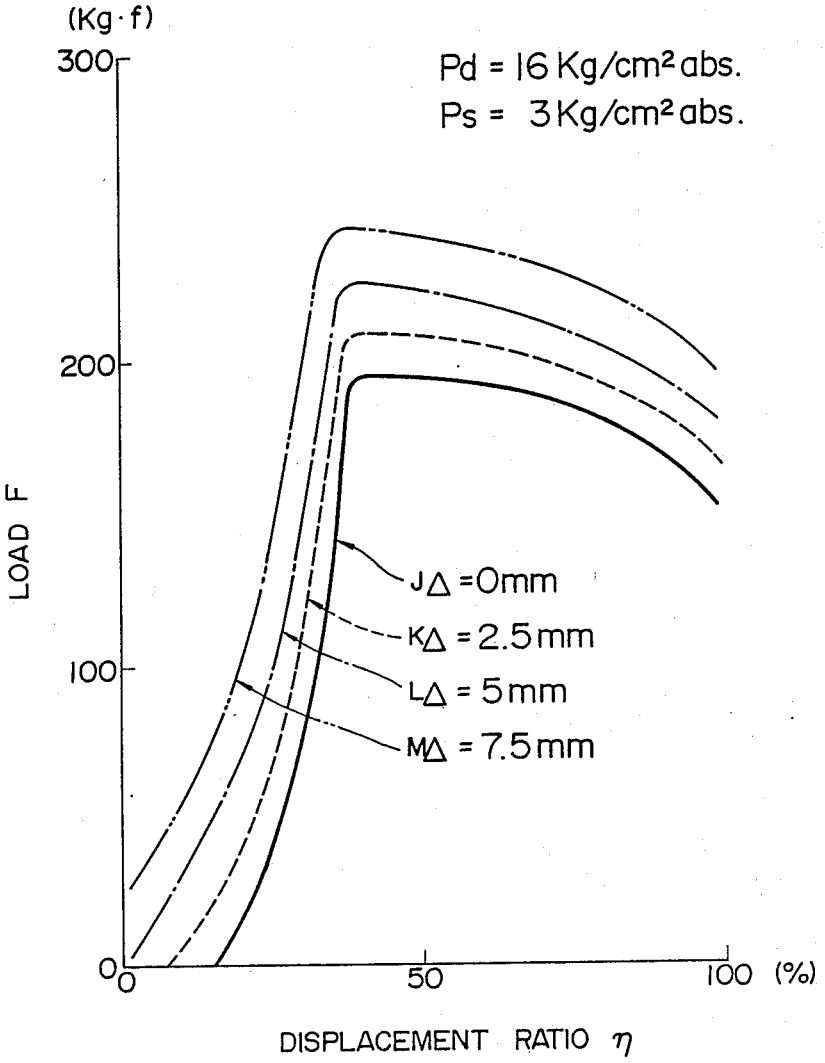
FIG. 25 is a graph showing a relationship between the compressor displacement ratio and thrust load acting on the spool.

Thus, in the embodiment shown in FIG. 24, a small dead volume is formed in the second variable volume chamber 60 when the spool 30 is set at a small travel position. In consequence, a pressure change caused due to the dead volume produces a force which acts through the pistons 7 on the swash plate 10 thereby urging the swash plate in the direction to reduce the tilting angle. This is illustrated in FIG. 25 in which a solid-line curve J represents the characteristic obtained when the distance Δ between the apparent hinge point 1001 and the center of the shoes 18 and 19 is zero, i.e., when no dead space is formed in the second, variable volume chamber 60. Characteristics obtained when the distance Δ is 2.5 mm, 5 mm and 7.5 mm are represented, respectively, by a broken-line curve K, a one-dot-and-dash line L and a two-dot-and-dash line M. As will be understood from these lines K, L and M, the load F is increased as the dead volume is increased. The increase in the load F causes the total pressing force $FPS_i$ exerted on the swash plate 10 by pistons 7, so that the aforementioned inequality is satisfied, thus ensuring that the displacement of the compressor can be controlled down to the minimum value.

Figure 26:
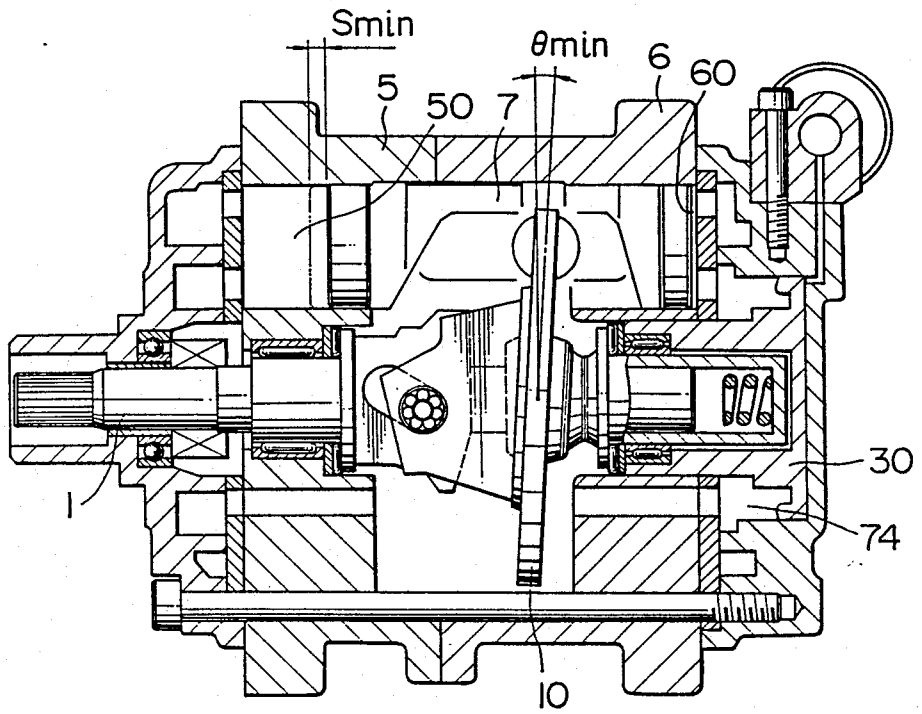
FIG. 26 is an axial sectional view of a still further embodiment of the swash-plate type compressor of the present invention.
Figure 27:
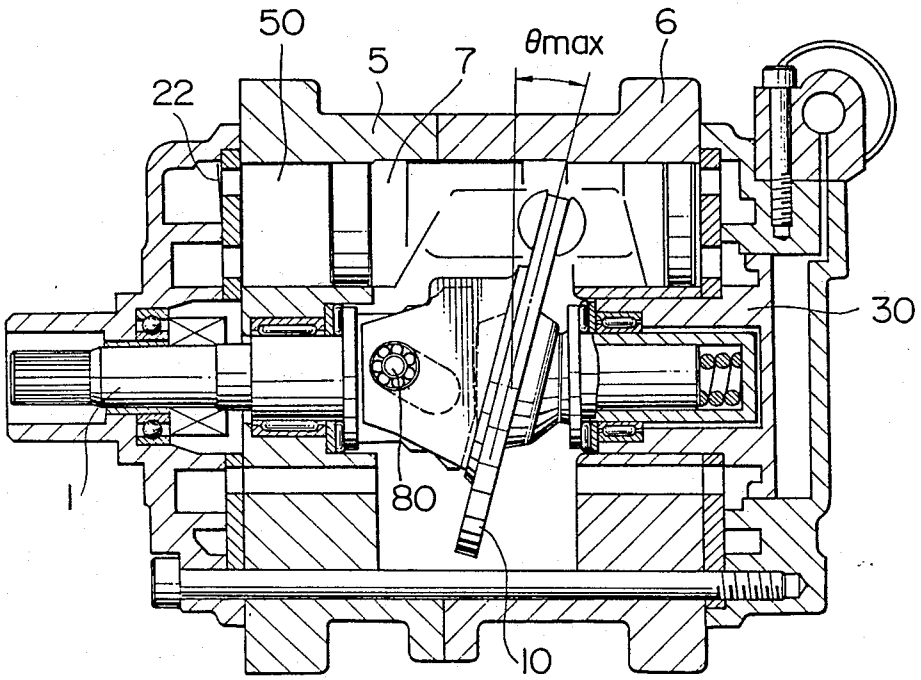
FIG. 27 is an axial sectional view of the compressor shown in FIG. 26 with the compressor shown in a different position of operation.

FIGS. 26 and 27 show a compressor provided with the auxiliary biasing means of the type shown in FIG. 24, in different states of operation. More specifically, FIG. 26 shows the state in which the displacement of the compressor has been reduced to the minimum. It will be apparent from this figure that the tilting angle $\theta$ of the swash plate 10 and, hence, the stroke S of the pistons 7 are minimum. Thus, the pressure in the first working chamber 50 in the state shown in FIG. 26 does not reach the level of the discahrge pressure, so that the discharge valve is kept closed. FIG. 27 shows the compressor in the state in which the displacement of the compressor has been maximized.

In the preceding embodiment, the apparent hinge point 1001 is varied to cause a dead space to be formed in the second working chamber 60 so that the compressor operates at its minimum displacement capacity. This can also be achieved by offsetting the apparent hinge point 1001 to decrease the angle of inclination of the swash plate 10 by mechanical means which will be described hereunder.

Figure 42:
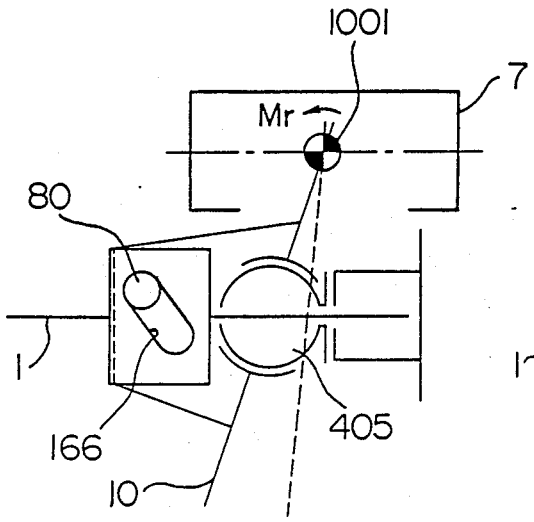
FIGS. 42 and 43 are diagrammatic illustrations of apparent hinge points.

Referring to FIG. 42, in the case where the angle of inclination of the swash plate 10 is changed with the apparent hinge point 1001 being at the rear side top dead center of the piston 7, the high pressure produced in the second working chamber 60 is scarecely related to the moment in the direction to decrease the angle of inclination of the swash plate 10.

Figure 43:
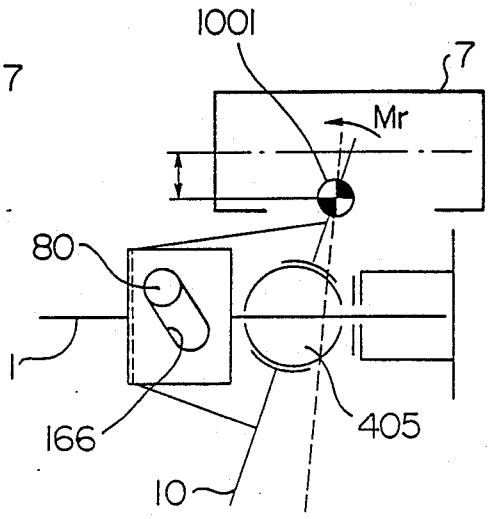
Figure 44:
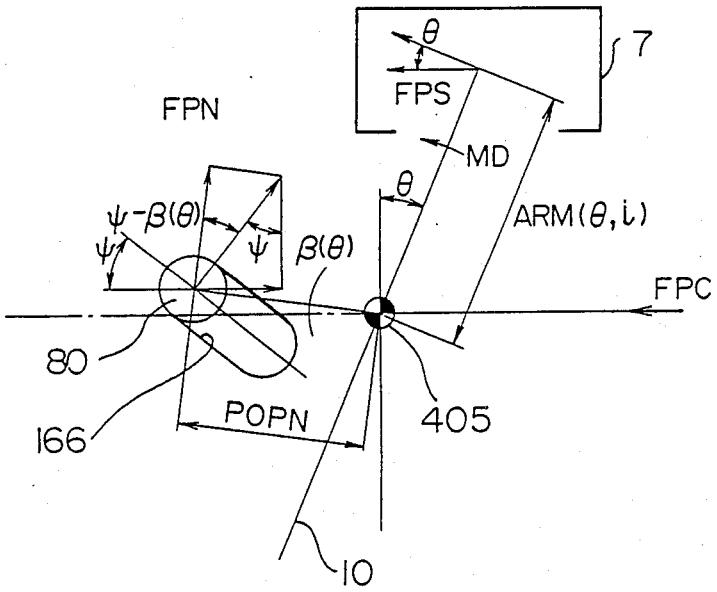
FIG. 44 diagrammatically illustrates the load on the swash plate.

As shown in FIG. 43, therefore, the apparent hinge point 1001 is shifted towards the shaft 1, so that a moment Mr is produced in a direction to decrease the angle of inclination of the swash plate 10. This moment is effective to minimize the force EPSi acting in the direction to minimize the compressor displacement capacity.

The moment Mr about the center of the spherical support portion 405 is given by:

$$\sum_{i=1}^{n}\left\{\frac{FPS}{\cos\theta}ARM(\theta\cdot i)\right\}+\frac{FPN}{\cos\{\phi-\beta(\theta)\}}POPN+Mr=0$$

where N represents the number of the pistons 7, FPS represents the axial resultant force produced by the load and inertia accompanying the piston compression strokes, ARM ($\theta$, i) represents the arm length from the center of the spherical support portion 405 to the center of each piston, POPN represents the arm length from the center of the spherical support portion 405 to the pin 80, $\phi$ represents the angle of inclination of the elongated slot 166, FPN represents the reaction force produced on the pin 80, FSH is the angle component of the reaction force FPN on the pin 80, $\beta(\theta)$ is the angle between the axis of the shaft 1 and the line between the center of the spherical support portion 405 and the pin 80, Mr represents the moment produced by the centrifugal force of the swash plate 10 and FPC is the urging force of the spool 3.

The axial loads are balanced as follows:

$$\sum_{i=1}^{n} FPS + FSH + FPC = 0$$

where FPC is the force for urging the spool 3 and $$\frac{FPN}{\cos\{\phi-\beta(\theta)\}}\sin\phi.$$

FSH is given by

In other words, if the loads accompanying the compression strokes of the pistons 7 are equal, the reaction force FPN produced on the pin 80 is equal and, thus, the greater is the angle of inclination of the elongated slot 166, the greater is the axial component FSH of the reaction force FPN on the pin 80 and, accordingly, the greater is the spool load FPC.

Figure 45:
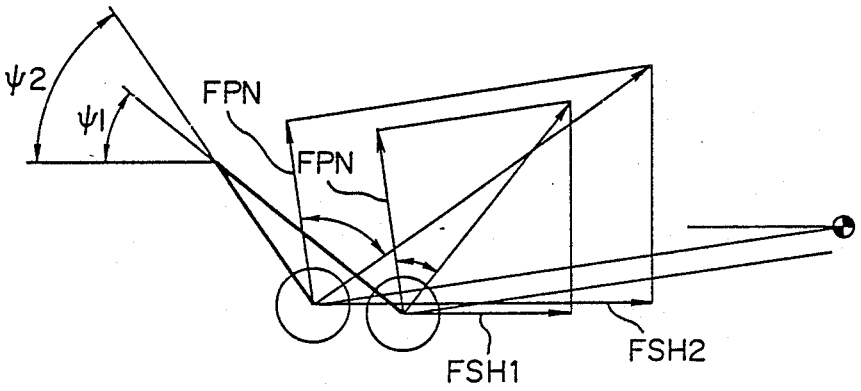
FIGS. 45 and 46 are diagrammatic illustrations of the loads on the pin.

FIG. 45 diagrammatically illustrates the loads of the elongated slot 166 and the pin 80 when the angle of inclination $\phi$ of the slot 166 is changed during the minimum displacement operation. FSH1 and FSH2 are axial components of the reaction force on the pin 80 obtained when the slot inclination angle $\phi$ is varied to $\phi_1$ and $\phi_2$ ($\phi_2$ is greater than $\phi_1$). It will be seen that FSH2 is greater than FSH1. Thus, it will be appreciated that to increase the angle of inclination of the elongated slot 166 is effective to assure the minimum compressor displacement capacity.

Figure 46:
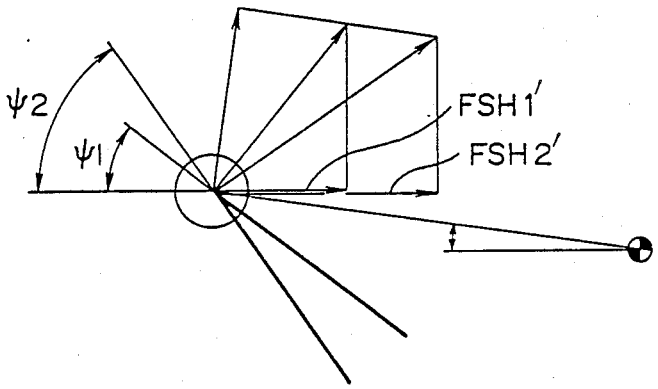
Figure 47:
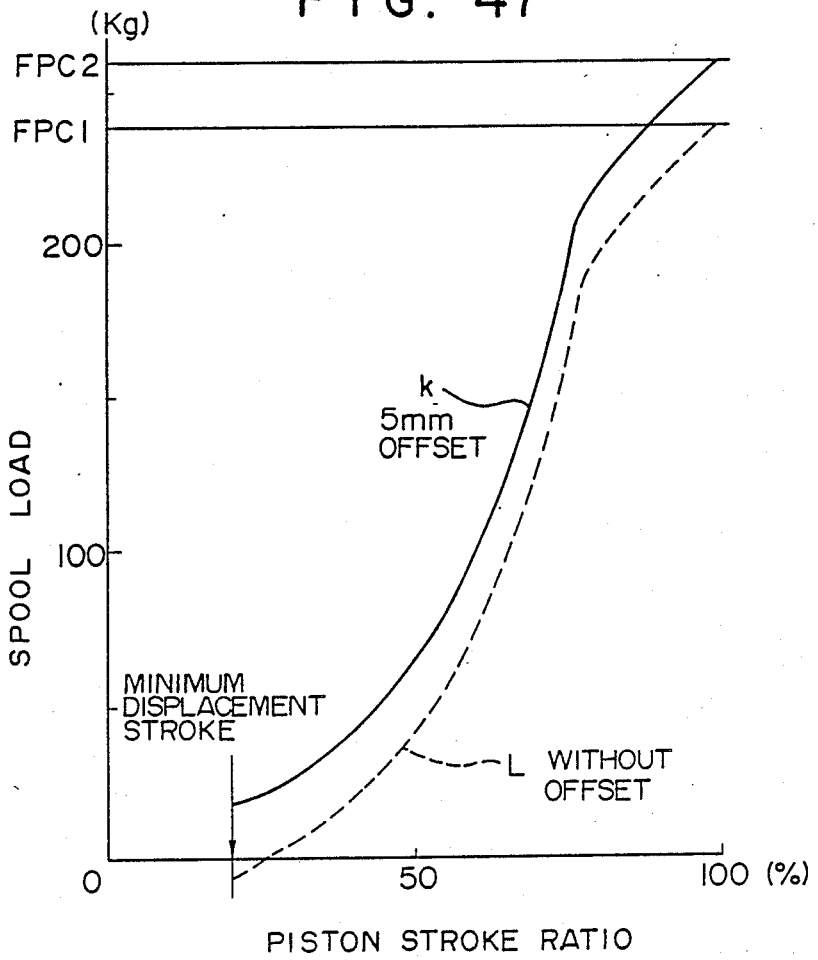
FIG. 47 graphically illustrates the relationship between the piston stroke ration and the load on the spool.

This effect, however, comes out not only in the minimum displacement operation but also in the maximum displacement operation. More specifically, even when the compressor is in its maximum displacement operation, a disadvantage takes place that, as the angle of inclination of the slot 166 is increased, FSH2' becomes greater than FSH1, as will be seen in FIG. 46. This will means that, if the elongated slot 166 is made substantially linear or straight to make the amount of offset of the apparent hinge point 1001 constant, a characteristic is obtained that is shown by a solid line K in FIG. 47. A broken line L in FIG. 47 represents a condition in which the apparent hinge point 1001 is positioned at the center of each piston 7. It will be seen in FIG. 47 that the solid line K is located above and substantially parallel to the broken line L. This will mean that the spool load required in the maximum piston stroke operation is increased. The pressure Pc fed to the control pressure chamber 200 when the pressure is in its maximum value is equal to the discharge pressure Pd. Thus, if the diameter of the spool 30 is to be increased, a problem occurs that other measures are required.

Figure 48:
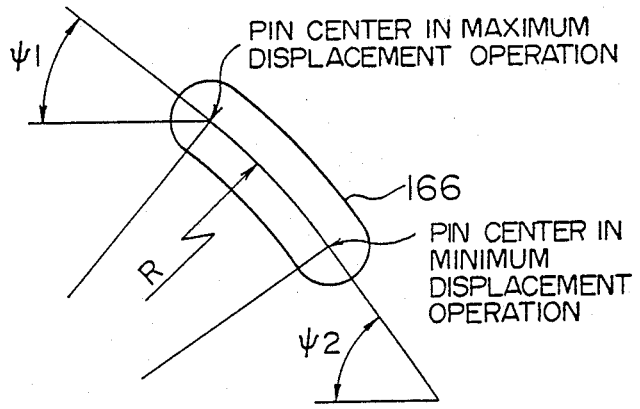
FIG. 48 illustrates the shape of the slot.

This problem is solved in this embodiment by increasing the amount of the offset of the apparent hinge point 1001 in a relatively small compressor displacement operation region, i.e., in a compression operation region in which the stroke of the spool 30 is relatively short, and by decreasing the amount of the hinge point offset in a large compressor displacement operation. This can be achieved by an arcuate shape of the elongated slot 166, as shown in FIG. 48. The slot 166 is shaped such that the angle defined between the tangent line of the slot 166 and the axis of the shaft is set as being $\phi_1$ during the maximum compressor displacement operation and as being $\phi_2$ during the minimum compressor displacement operation.

Figure 49:
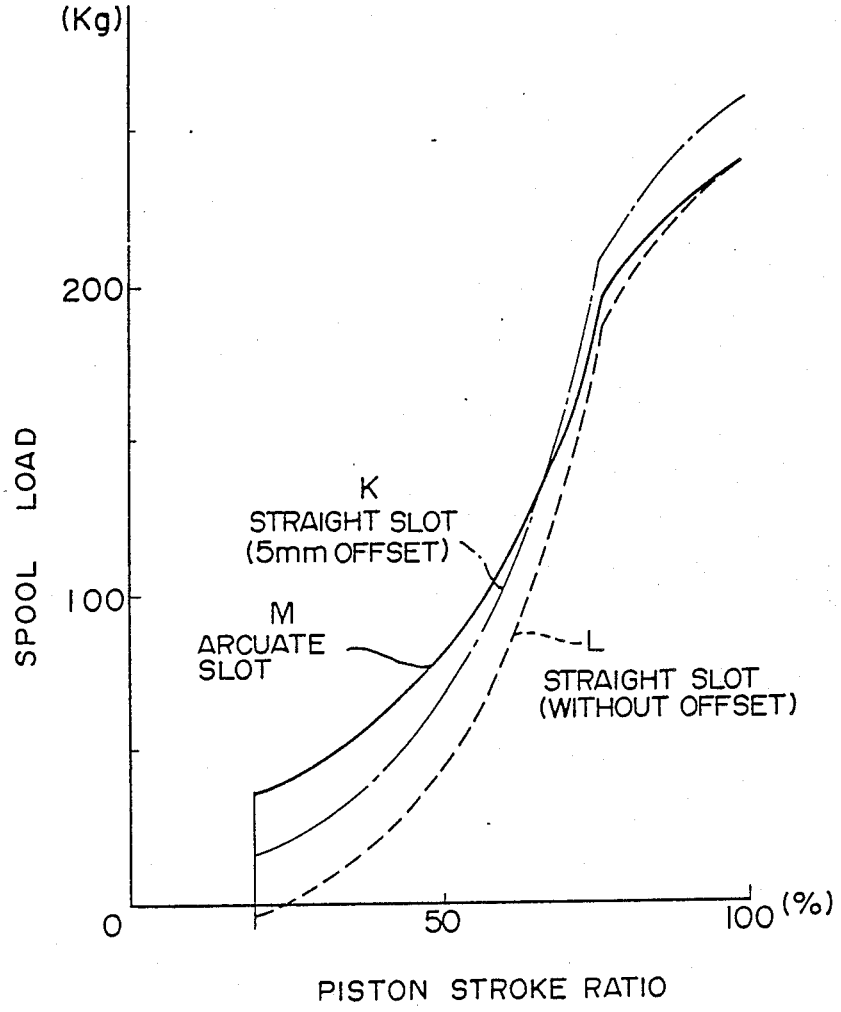
FIG. 49 graphically illustrates the relationship between the piston stroke ratio and the load on the spool.
Figure 50:
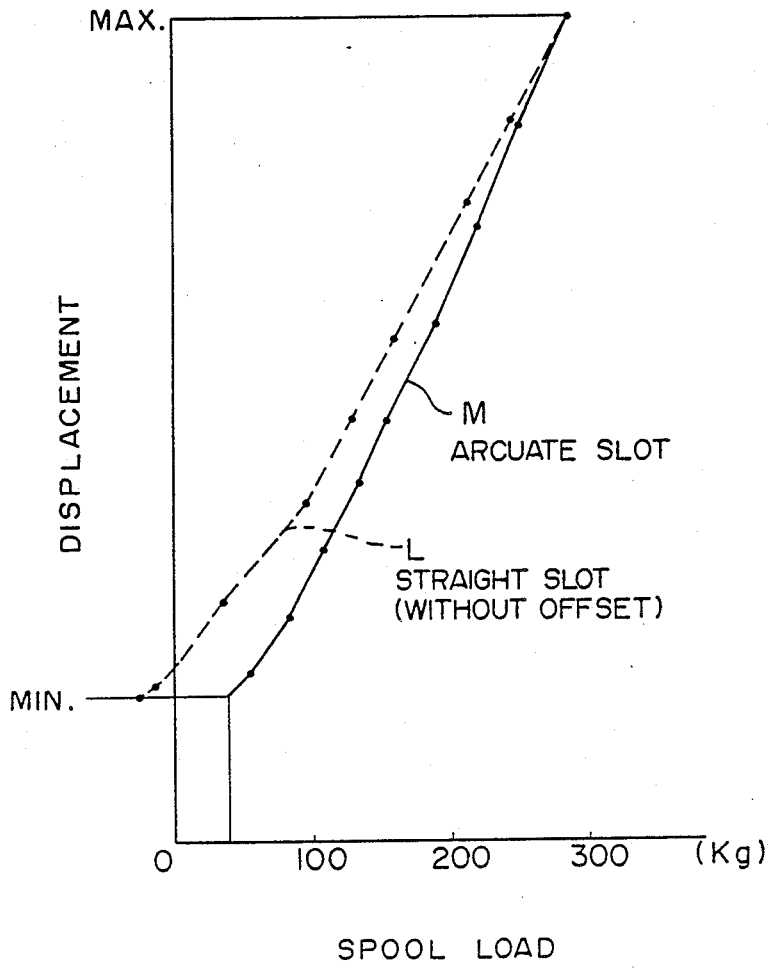
FIG. 50 graphically illustrates the relationship between the load on the spool and the compressor displacement.

The result from the arcuate slot 166 is shown in FIG. 49 wherein a solid line M shows the result from the arcuate slot 166, the dot and dash line K shows the result from the straight slot 166 with the apparent hinge point 1001 being offset 5 mm, and the broken line L shows the result from the straight slot 166 with the apparent hinge point 1001 being not offset. As will be seen in FIg. 49, the arcuate slot 166 ensures that minimum displacement is assured at 40 kg with the maximum spool load being unchanged. It will also be understood from FIG. 50 that the slot 166 in the arcuate shape is reliable to achieve the minimum compressor displacement. The solid line M in FIg. 50 shows the result from the arcuate slot 166 while the broken line L shows the result from the straight slot with the apparent hinge point 1001 located at the center of each piston 7.

In the preceding embodiment, the force to urge the swash plate 10 is varied by mechanical means. This force may alternatively be varied by lowering the pressure in the second working chamber 60 to minimize the compressor displacement. To lower the second working chamber pressure can be achieved either by lowering the suction pressure or by lowering the discharge pressure. To lower the suction pressure on the side of the second working chamber 60 is more practical and can be achieved preferably by restricting the refrigerant suction passage.

Figure 51:
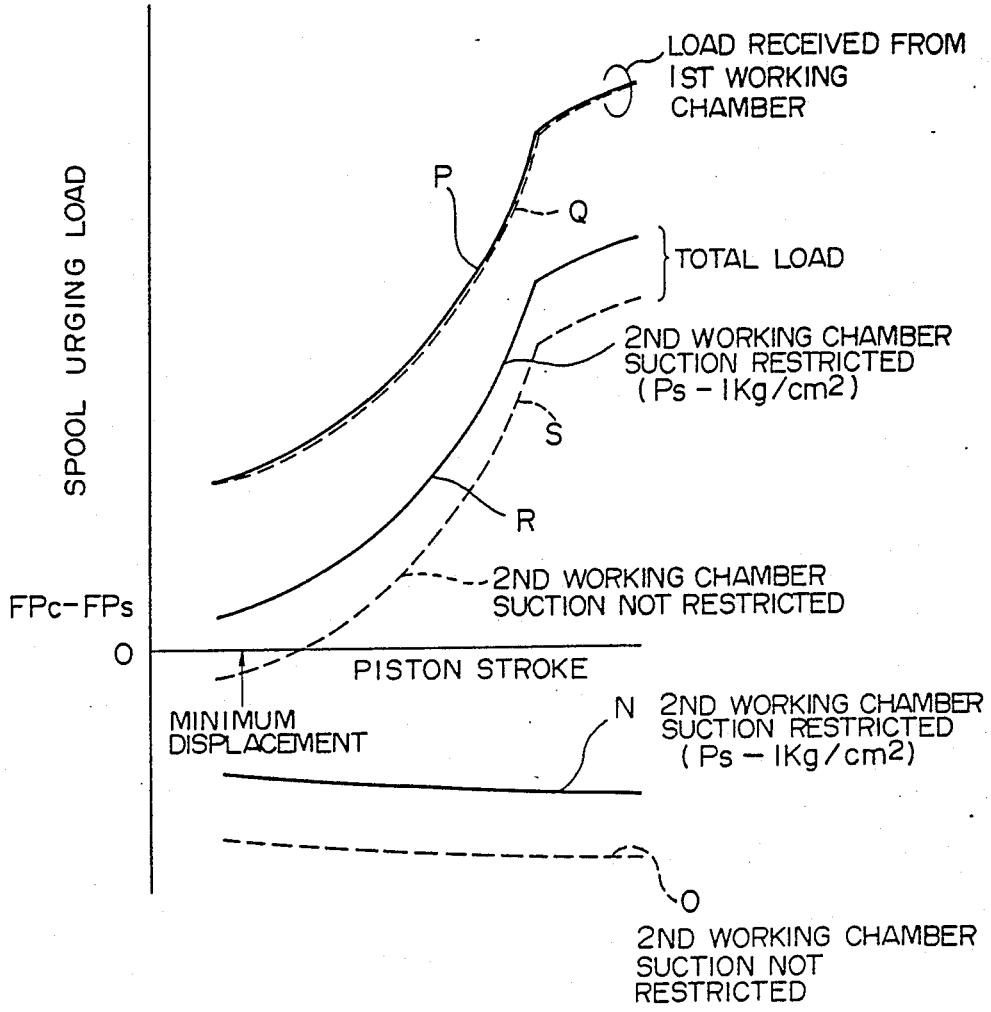
FIG. 51 graphically illustrates the relationship between the piston stroke and the spool urging force.

FIG. 51 graphically illustrates how the spool urging force or load is influenced when the suction pressure on the side of the second working chamber 60 is lowered 1 kg/cm$^2$. In this figure, the solid line N represents the case where the suction into the second working chamber 60 is restricted, whereas the broken line O represents the case where the suction for the second working chamber is not restricted. The solid line P and the broken line Q represent the loads received from the side of the first working chamber. The solid line R and the broken line S represent the total load on the spool 30. The solid line R represents the case where the suction for the second working chamber 60 is restricted, whereas the broken line S is representative of the case where the suction for the second working chamber 60 is not restricted. It will be understood that to restrict the suction into the second working chamber 60 reduces the load applied to the spool from the side of the second working chamber 60 while the load applied to the spool from the side of the first working chamber is unchanged, with a result that the total load on the spool is increased to assure the minimum compressor displacement.

Figure 52:
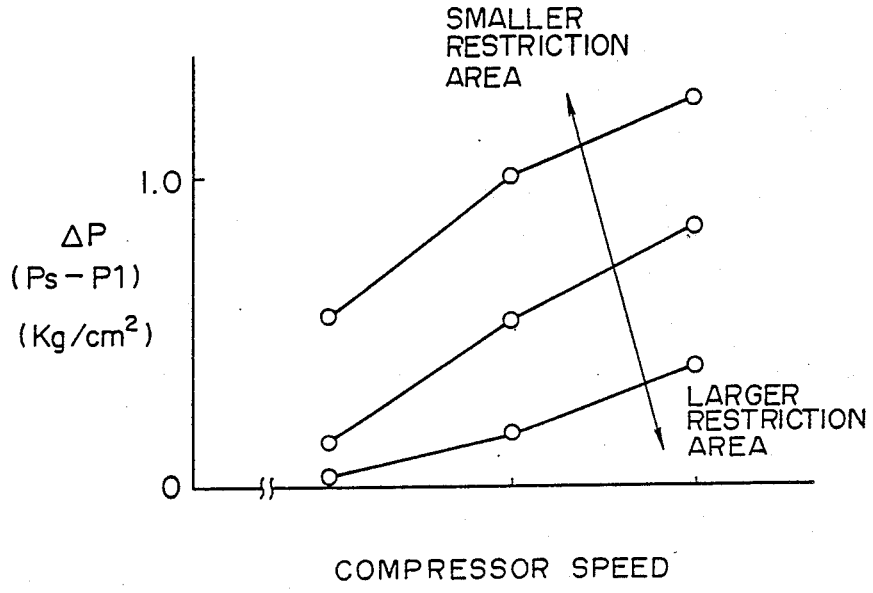
FIG. 52 graphically illustrates the relationship between the compressor speed and the degree of an intake restriction.

FIG. 52 shows results of measurements concerning the relationship between the compressor speed and the suction pressure Ps varied by changing the cross-sectional area of a restriction for the suction passage during the minimum displacement operation. It will be seen in FIG. 52 that, by selecting the cross-sectional area of the restriction, a sufficient effect is attained even during a small displacement operation wherein the fluid flows at a low rate.

Figure 53:
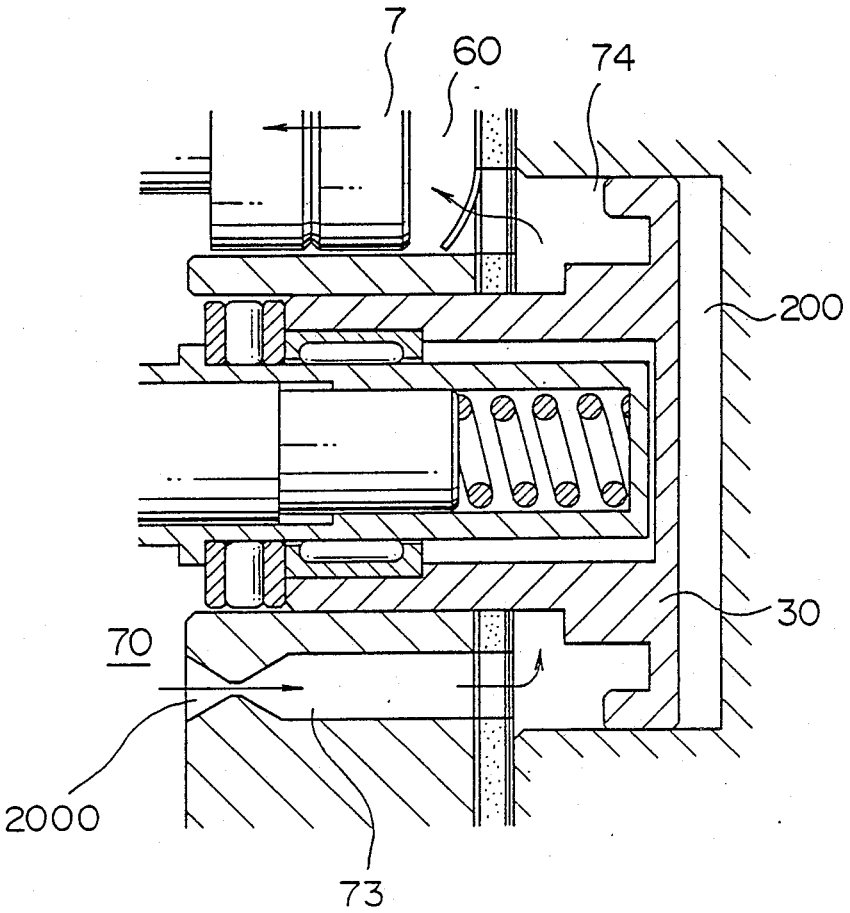
FIG. 53 is an enlarged fragmentary sectional view of the compressor showing an intake restriction provided therein.

FIG. 53 shows a restriction 2000 provided between the suction pressure chamber 70 and the rear side suction chamber 74, so that the refrigerant flows from the chamber 70 through the restriction 2000 and the suction passage 73 and the suction chamber 74 into the second working chamber 60. It will be noted that the provision of the restriction 2000 reduces the pressure in the suction chamber 74 to a level below the pressure level Ps attained in the case where the restriction 2000 is not provided. Thus, the restriction 2000 achieves the effect discussed above.

Such a fixed restriction, however, restricts the flow of the refrigerant into the compressor even during a large compressor displacement operation not only to lower the performance of the compressor but also to so increase the spool urging load that the diameter of the spool must be increased to assure the maximum compressor displacement operation.

Figure 54:
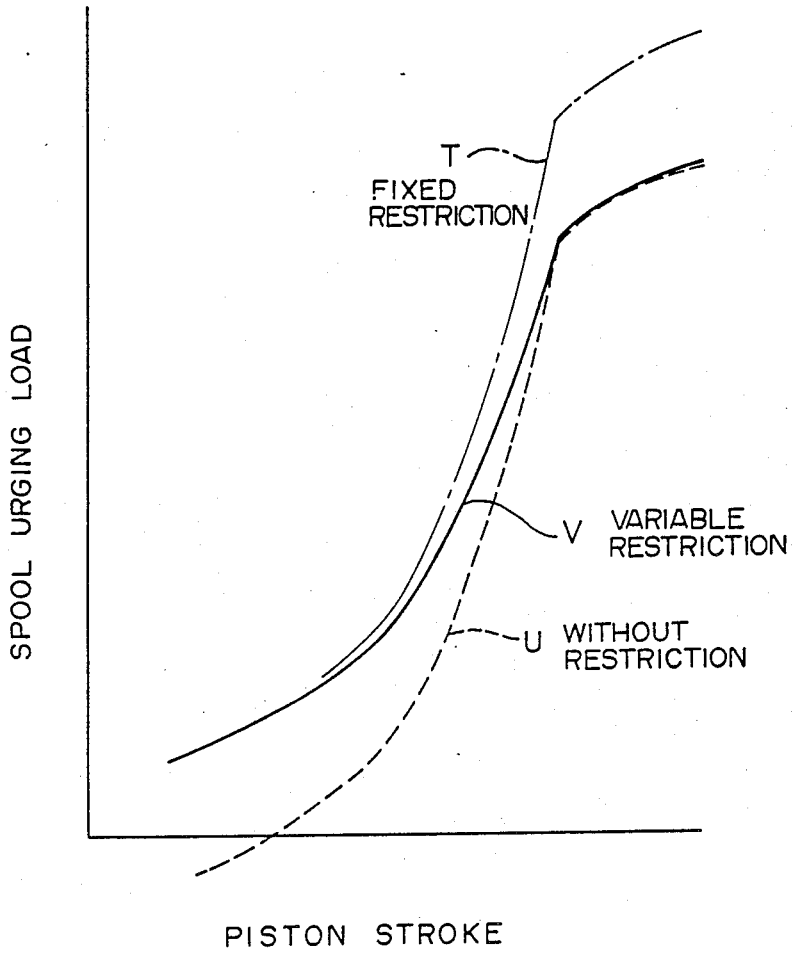
FIG. 54 graphically illustrates the relationship between the piston stroke and the spool urging force.

This problem is solved by a variable restriction operative to greatly restrict the suction passage only during a small compressor displacement operation and not to restrict the suction passage during a large compressor displacement operation, as will be seen from the characteristic shown by a solid line V in FIG. 54. Dot and dash line T and broken line U in FIG. 54 respectively show characteristics obtained when the fixed restriction 2000 is provided in the suction passage for the second working chamber 60 and when no restriction is provided for the suction passage.

Figure 55:
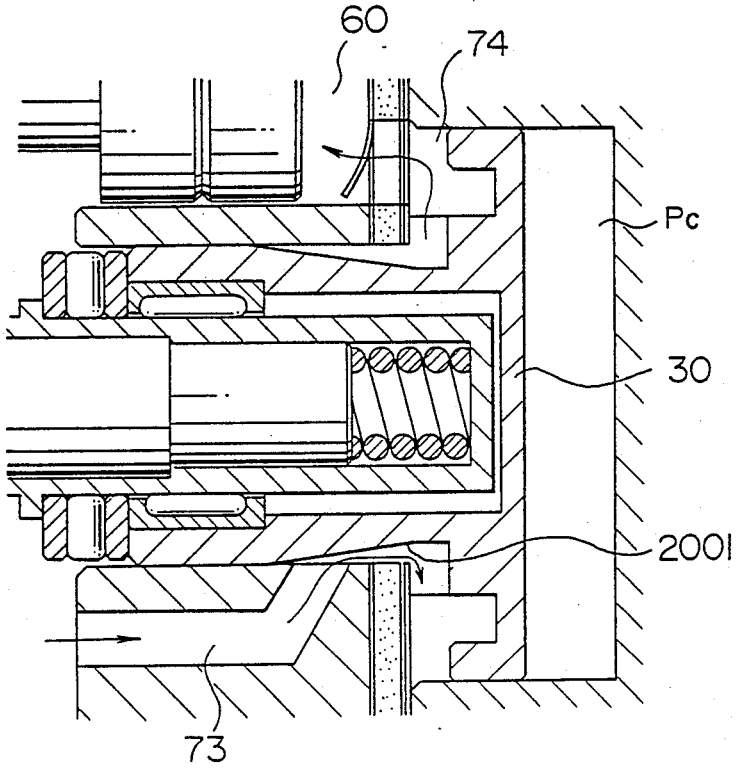
FIGS. 55 and 56 are enlarged fragmentary sectional views of compressor provided with another example of the intake restriction provided therein.
Figure 56:
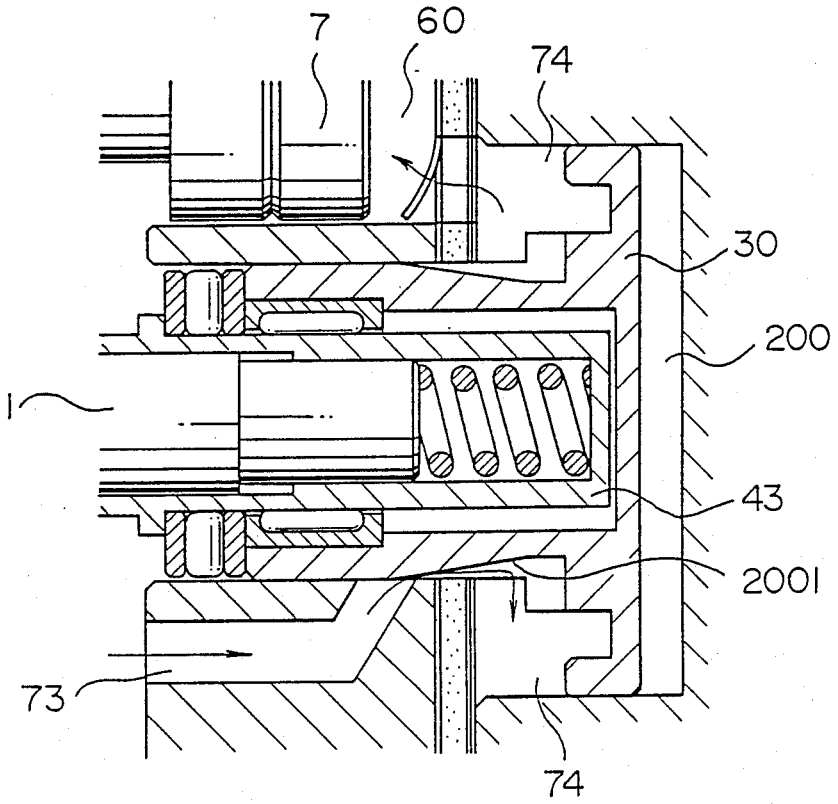

A further embodiment in which such a variable restriction is provided in the suction passage 73 is shown in FIGS. 55 and 56, FIG. 55 showing the compressor when in its maximum displacement operation with the spool 30 being shifted to the left end position as viewed in the figure. In this embodiment, a suction passage 2001 is formed in the spool 30 and tapered so that the suction passage 2001 and the compressor housing cooperate to define a fluid-flow cross-section which is large enough to allow the refrigerant to flow through the suction passages 73 and 2001, as shown in FIg. 55, when the compressor is in its large displacement operation.

On the other hand, when the compressor is in its small displacement operation shown in FIG. 56, the fluid-flow cross-section of the suction passage 2001 formed in the spool is decreased or restricted by the cooperation of the spool with the compressor housing, so that the flow of the refrigerant through the suction passages 73 and 2001 is greatly restricted.

Figure 57:
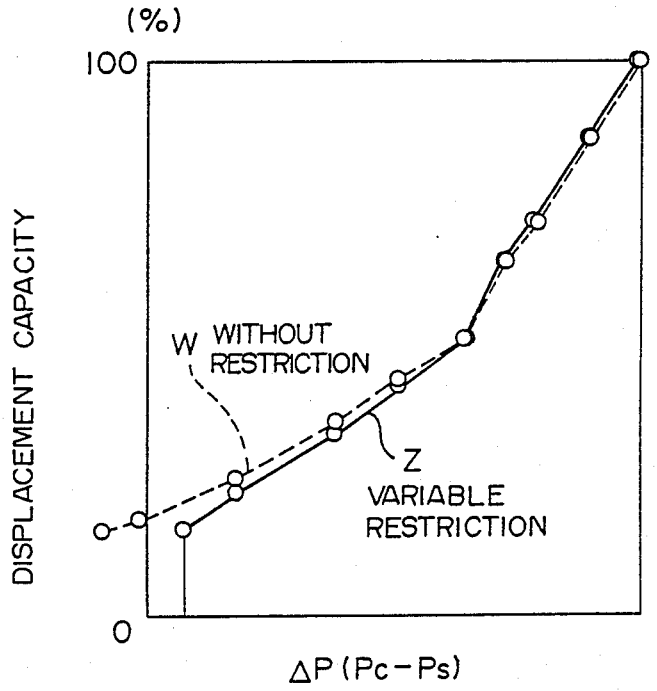
FIG. 57 graphically illustrates the relationship between the degree of the intake restriction and the compressor displacement capacity.

A solid line curve Z in FIG. 57 shows a characteristic obtained from the embodiment having the variable restriction 2001 shown in FIGs. 55 and 56, a broken line curve W in FIG. 57 showing a characteristic obtained from an embodiment without any restriction. It will be seen from the comparison between the curves X and Z in FIg. 57 that the embodiment without restriction cannot assure the minimum compressor displacement operation unless the pressure Pc in the control pressure chamber 200 is made lower than the pressure Ps in the suction chamber 74, whereas the embodiment shown in FIGS. 55 and 56 assures the minimum compressor displacement operation even with the pressure Pc in the control pressure chamber 200 being higher than the pressure Ps in the suction chamber 74.

Figure 58:
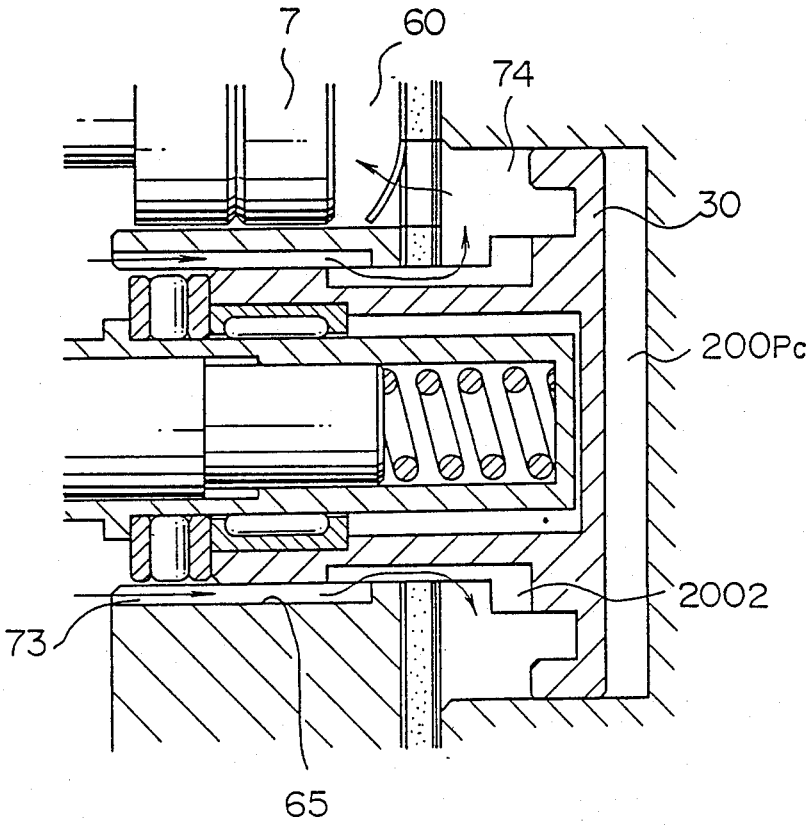
FIG. 58 is an enlarged sectional view of a compressor provided with a still another example of the intake restriction.

FIG. 58 shows a modification to the embodiment shown in FIGs. 55 and 56. In this modification, the suction passage 73 is formed in the cylindrical inner peripheral surface 65 of the compressor housing and the suction passage 2002 is formed in the outer peripheral surface of the spool 30. The adjacent ends of the suction passages 73 and 2002 are arranged such that these ends restrict the flow of the refrigerant through these suction passages when the compressor is in its small displacement operation with the spool 30 moved toward the left stroke end position as viewed in FIG. 58.

In the described embodiments, the auxiliary shifting means utilizes the force FPSi (shown in FIG. 17) for pressing the swash plate 10. The auxiliary shifting means, however, may alternatively utilize the thrust forces EPs and EPc (see FIG. 17).

Figure 59:
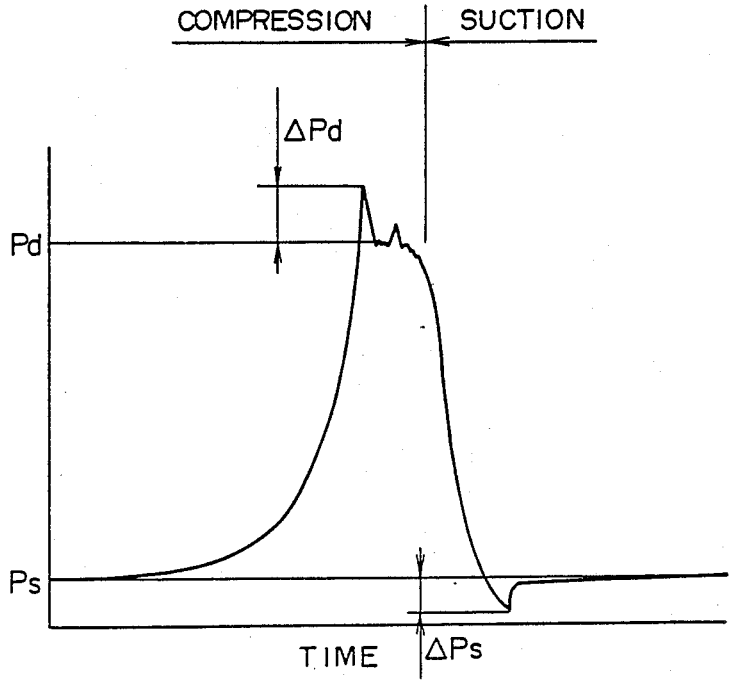
FIG. 59 diagrammatically illustrates the pressure change in a working chamber.

This alternative way can be achieved by feeding into the control pressure chamber 200 a pressure signal which is either at a level higher than the discharge pressure Pd or at a level lower than the suction pressure Ps so that the pressure Pc in the control chamber is at either one of the levels referred to. As a means for producing the pressure signal, the applicants' attention has been paid to the fact that the pressure in the second working chamber is varied as shown in FIG. 59. The pressure variation shown in FIG. 59 is the actual one which takes place in the working chamber 60, whereas FIG. 11 shows ideal or desirable relationship between the pressure in the working chamber and the displacement. More specifically, in the actual working chamber, effects such as the inertias of the discharge valves 22 and the suction valves 9 cause an overshoot ΔPd in a suction stroke and an undershoot ΔPs can be utilized as the pressure Pc in the control pressure chamber for thereby widening the range of the control pressure.

Figure 60:
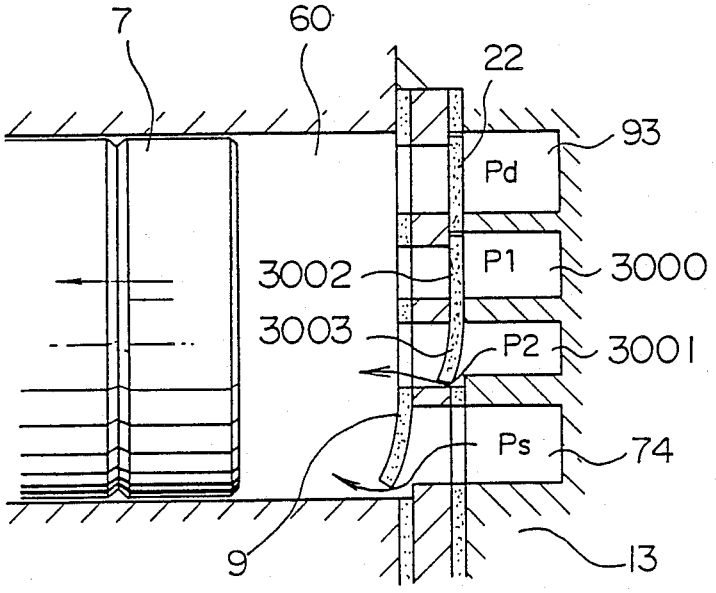
FIGS. 60 and 61 are enlarged fragmentary sectional views of an embodiment in which high and low pressure chambers are provided.
Figure 61:
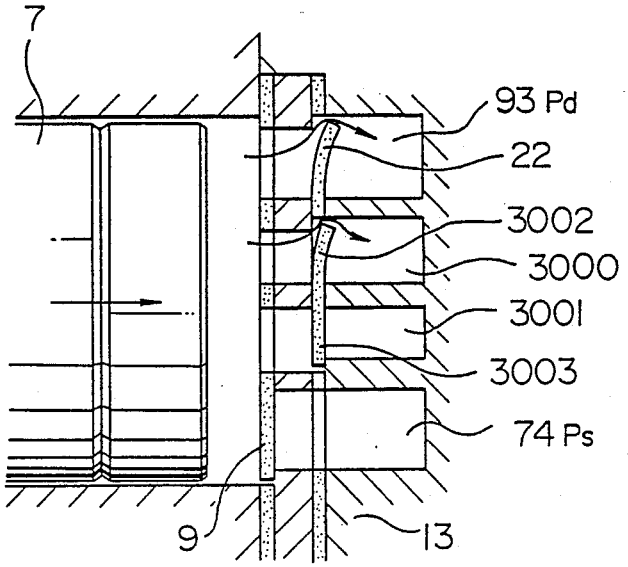

FIGS. 60 and 61 show an embodiment which includes an auxiliary means for taking the overshoot ΔPd and undershoot ΔPs out of the second working chamber 60 and feeding them into the control pressure chamber 200. As will be seen in FIGS. 60 and 61, high and low pressure chambers 3000 and 3001 are formed in the rear housing 13 and independently of the discharge chamber 93 and the suction chamber 74. The high and low pressure chambers 3000 and 3001 are in the form of closed chambers, respectively, and communicated with the second working chamber 60 respectively through high and low pressure valves 3002 and 3003 which are made of materials having stiffnesses lower than those of the discharge valve 22 and the suction valve 9 so that the low pressure valve 3003 alone opens first when the pressure P in the second working chamber 60 is lowered in a suction stroke to a level approximately equal to the suction pressure Ps. Thereafter, the suction valve 9 is opened. During the time period between the moment when the low pressure valve 3003 is opened and the moment when the suction valve 9 is opened, the pressure in the low pressure chamber 3001 is lower than the suction pressure Ps by the undershoot ΔPs. After the suction valve is opened, the pressure P in the second pressure chamber 60 is increased to the suction pressure Ps, so that the low pressure valve 3003 is closed, whereby the low pressure chamber 3001 is always kept at a level lower than the suction pressure Ps by the undershoot ΔPs.

When a piston 7 commences its compression stroke, the high pressure valve 3002 is opened before the discharge valve 22 is opened. Thus, the pressure in the second working chamber 60 is increased to a level higher than the discharge pressure Pd by the overshoot ΔPd. This higher pressure can be introduced into the high pressure chamber 3000. After the discharge valve 22 is opened, the pressure in the second working chamber 60 is lowered to the discharge pressure Pd. Namely, the overshoot ΔPd is cancelled, so that the pressure in the second working chamber 60 is relatively lowered. Thus, the high pressure valve 3002 is immediately closed, whereby the high pressure chamber 3000 is always kept at a pressure higher than the discharge pressure Pd by the overshoot ΔPd.

It will therefore be appreciated that a greater force for urging the spool 30 can be obtained by the arrangement that the high pressure chamber 3000 is communicated through the high pressure passage 96 with the control valve 400 and the low pressure chamber 3001 is communicated through the low pressure passage 97 with the control valve 400. Especially when the low pressure is fed from the low pressure chamber 3001 into the control pressure chamber 200, the spool is reliably shifted to assure the minimum compressor operation.

Figure 62:
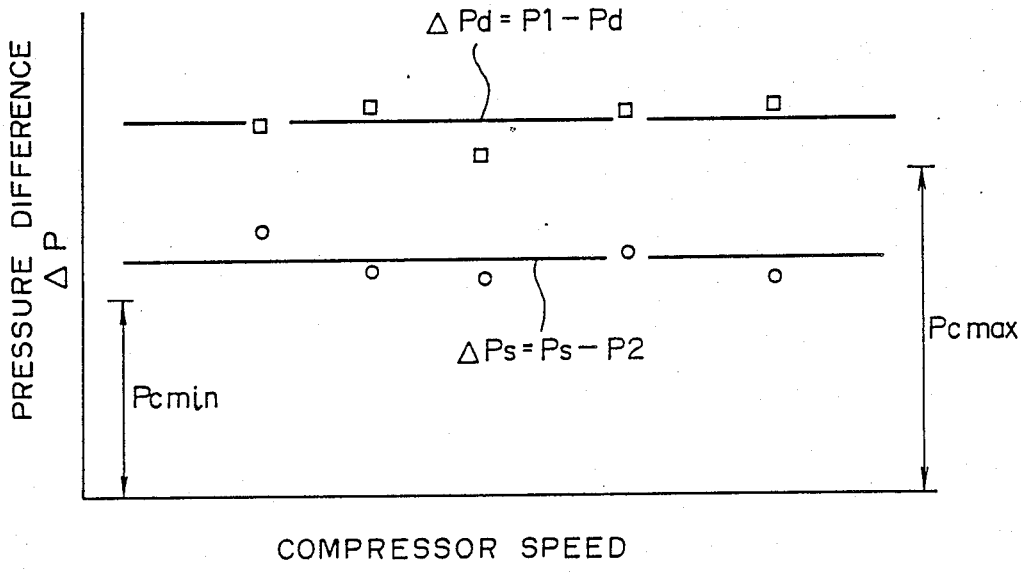
FIG. 62 graphically illustrates the relationship between the compressor speed and the overshoot.

FIG. 62 shows the results of actual measurements of the overshoot ΔPd and the undershoot ΔPs relative to various compressor speeds. It will be understood from this figure that the overshoot ΔPd and the undershoot ΔPs can advantageously be utilized to achieve the control pressures Pcmax and Pcmin respectively required for the maximum and minimum shift strokes of the spoool 30.

Figure 28:
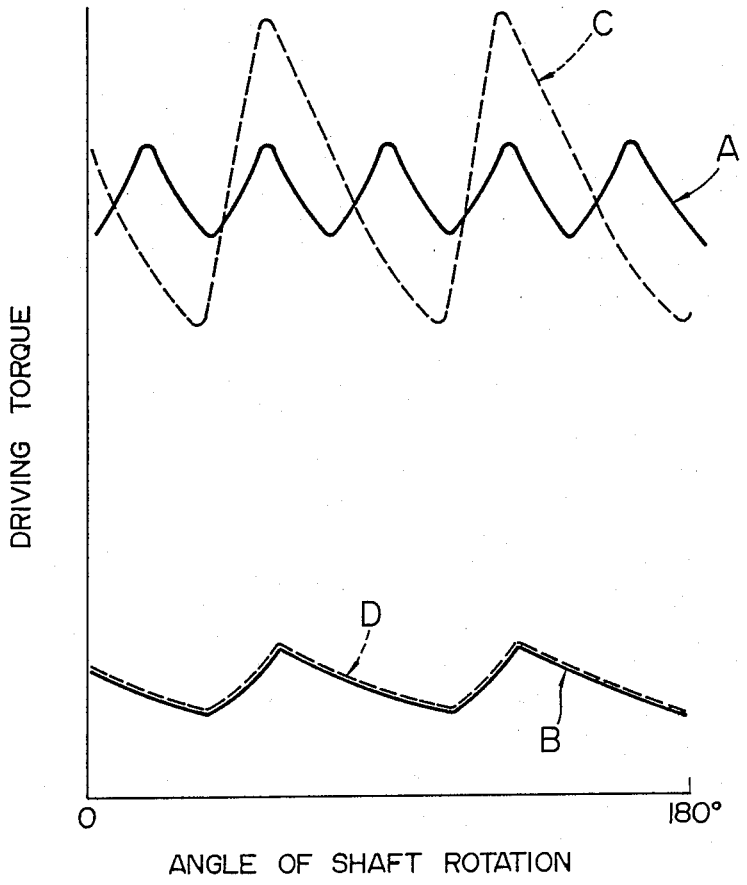
FIG. 28 is a graphical illustration of the torque varied in the compressor shown in FIG. 26.

FIG. 28 shows the operation characteristic of this compressor in comparison with that of a known compressor of the type shown in Japanese Unexamined Patent Publication No. 60-175783 in which pistons are provided only on one side of the swash plate. Solid-line curves A and B in this figure represent the driving torques of the compressor in accordance with the present invention, while broken-line curves C and D represent the driving torques in the known compressor having pistons only on one side of the swash plate. The curves A and C show the levels of driving torques required when the respective compressors operate with their maximum displacements, while the curves B and C show the levels of driving torques required when the respective compressors operate with their minimum displacements. In FIG. 28, the axis of abscissa represents the angle of rotation of the shaft.

As will be understood from FIG. 28, the levels of the driving torques in both compressors are substantially the same when the displacements are minimum. This is because, in the minimum displacements only the second working chamber 60 are operative and the first working chambers 50 are inoperative even in the compressor of this embodiment.

However, when the displacement have been maximized, the level of the driving torque required by the compressor of this embodiment is much smaller than that required by the known compressor due to the fact that the amplitude of fluctuation in the required torque per rotation of the shaft is very small in the compressor of this embodiment because of the provision of the working chambers 50 and 60 on both sides of the pistons 7. In contrast, in the known compressor, the amplitude of fluctuation in the driving torque per rotation of the shaft is very large because pistons operate only on one side of the swash plate.

Another advantage provided by the compressor of the described embodiment is that the members for controlling the tilting movement of the swash plate 10, i.e., the pin 80, elongated slot 166 and the spherical support portion 405, do not directly bear the driving torque because the transmission of the driving torque from the shaft to the swash plate relies upon the surface contact between the flat web portion 165 on the shaft 1 and the walls defining the slit 105 which receives this web portion.

In contrast, in the prior art compressors (known, for example, from Japanese Unexamined Patent Publication No. 58-162780), the torque for driving the swash plate and the thrust force exerted on the swash plate during compression are born by the pin which constitutes the center or fulcrum for the tilting motion of the swash plate. This arrangement undesirably limits the driving torque to be transmitted. The compressor of the described embodiment of the invention is free from this problem.

Furthermore, according to the invention, the control of the tilting motion of the swash plate 10 can be accomplished by the spool adapted to slide by a pressure differential across it, without necessitating any complicated and large-sized actuator such as a motor, thus enabling the swash-plate type compressor to have a reduced size and a compact construction.

Figure 29:
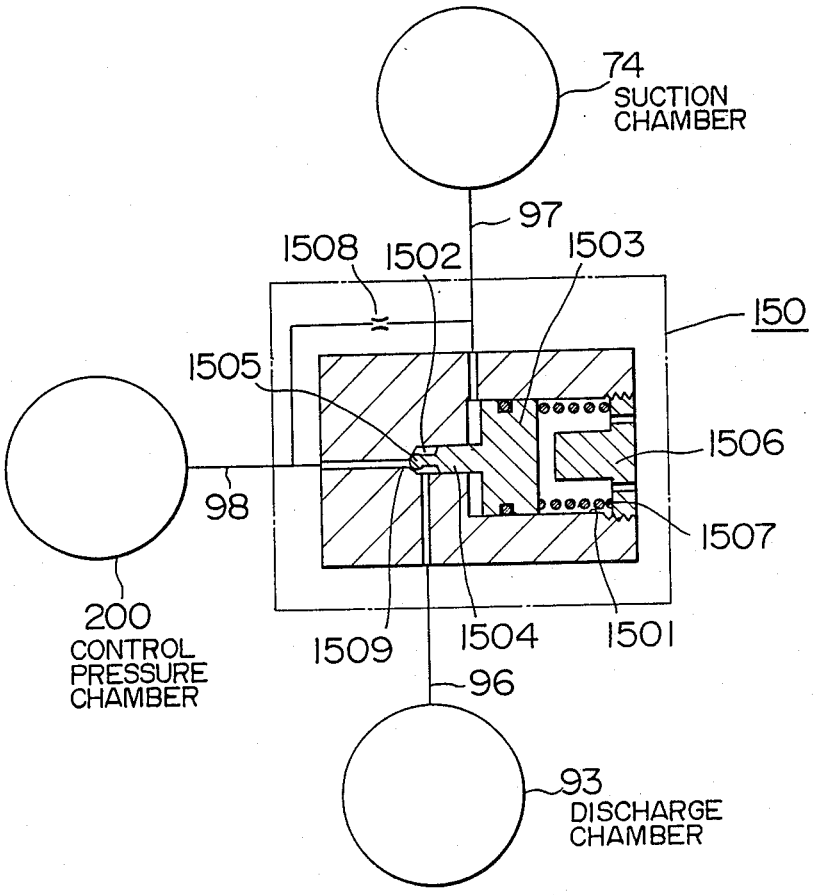
FIG. 29 is a circuit diagram showing an example of a control valve incorporated in a still further embodiment of the compressor of the present invention.

In the embodiments of the invention described hereinbefore, the displacement is controlled by changing the tilting angle and axial position of the swash plate by controlling the internal pressure of the control pressure chamber 200. The control of the internal pressure of the control pressure chamber 200 may be effected by means of such a pressure control valve 150 as is shown in FIG. 29. In general, the suction pressure of a compressor used in a refrigeration cycle becomes higher and lower as the cooling load is increased and decreased, respectively. The pressure control valve 150 incorporated in the embodiment shown in FIG. 29 is designed to detect the suction pressure to control the internal pressure of the control pressure chamber 200. The construction and operation of other portions of the compressor are materially the same as those in the embodiment shown in FIG. 1, so that detailed description is omitted.

The pressure control valve 150 is formed therein with a cylinder 1501 having a large-diameter portion and a small-diameter portion. A spool 1503 which also is constituted by a large-diameter portion and a small-diameter portion is slidably received in the cylinder 1501. Thus, the small-diameter portion 1502 of the cylinder receives the small-diameter portion 1504 of the spool 1503. A ball 1505 is fixed to the end of the small-diameter portion 1504. A spring 1507 is placed between the spool 1503 and a stopper 1506 so as to urge the spool 1503 forwardly. A port is formed in the wall of the cylinder 1501 near the end of the large-diameter portion of the spool 1503 and connected through a low pressure passage 97 to the suction chamber 74 and also to the control pressure chamber 200 through restriction orifice 1508. On the other hand, the discharge chamber 93 is connected to the small-diameter portion 1502 of the cylinder 1501 through a high pressure passage 96. A port 1509 is provided on the small-diameter portion 1502 of the cylinder 1501 and adapted to be opened and closed by the ball 1505. This port 1509 is connected to the control pressure chamber 200 through a communication passage 98.

The operation of the embodiment of the compressor shown in FIG. 29 is as follows:

The suction pressure corresponding to the level of the cooling load on the refrigeration cycle which is the target value of the control, is represented by $P_s$ (kg/cm$^2$ abs) which is attained by a pressure PST which is set by the spring 1507. In the initial or beginning stage of operation of the compressor, the cooling load is generally large, so that the suction pressure Ps in the suction chamber 74 is higher than the above-mentioned set pressure PST. This suction pressure Ps acts on the spool 1503 and displaces the spool 1503 to the right as viewed in FIG. 29 against the force of the spring 1507. As a result, the ball 1505 is moved away from a valve seat around the port 1509 to establish a communication between the control pressure chamber 200 and the discharge chamber 93. Thus, the pressure in the control pressure chamber 200 is elevated to the level of the discharge pressure Pd. As a result, the state of the compressor is gradually changed towards the state of maximum displacement as in the case of the preceding embodiment. As the compressor operation is continued, the cooling load is decreased, so that the suction pressure in the suction chamber 74 is lowered to the set pressure level PST and then down to a level below the level PST. Thus, the urging force produced by the spring 1507 becomes greater than the force produced by the suction pressure acting on the spool 1503, so that the spool 1503 is moved to the left as viewed in FIG. 29. As a result of this leftward movement, the ball 1505 is seated again on the valve seat around the port 1509, thereby interrupting the communication between the control pressure chamber 200 and the discharge chamber 93. As a result, the control pressure chamber 200 is brought into communication with the suction chamber 74 through the restriction orifice 1508, so that the pressure in the control pressure chamber 200 is gradually decreased to the level of the suction pressure, whereby the compressor becomes to operate with the minimum displacement as in the case of the first embodiment. This operation is conducted repetitionally so that the pressure in the suction chamber 74 is maintained at around the target level PST whereby the compressor displacement is controlled to match with the cooling load.

In the embodiment described with reference to FIG. 4, when the control valve 400 comprises an electromagnetic valve, it functions only to selectively connect and disconnect the control pressure passage 98 to and from the low-pressure introduction passage 97, while the high-pressure introduction passage 96 is always maintained in communication with the control pressure passage 98 thorugh the restriction orifice 99. This arrangement, however, may be modified such that control valve 400 selectively change over the passage 96 and 97.

Figure 30:
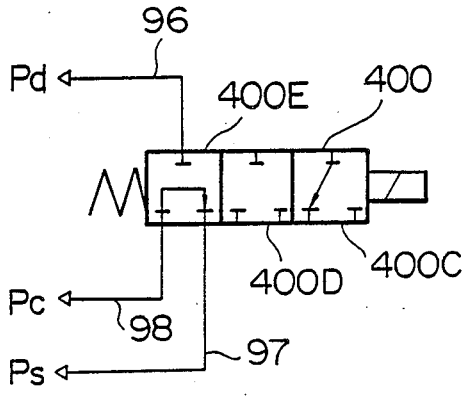
FIG. 30 is an illustration of another example of the control valve.

Such a modification can be accomplished or realized by a circuit which is shown in FIG. 30. When the control valve 400 is set in a position indicated by 400C, the high-pressure introduction passage 96 and the control pressure passage 98 are communicated with each other. In a position indicated by 400D, however, the control pressure passage 96 is disconnected from other passages 97 and 98. In a position indicated by 400E, the control pressure passage 98 is communicated with the low-pressure introduction passage 97. In the embodiment shown in FIG. 30, therefore, the control valve 400 is switched to the position 400C when it is necessary to elevate the pressure in the control pressure chamber 200, whereas, when it is required to reduce the pressure in the control pressure chamber 200, the control valve 400 is switched to the position 400E. Obviously, the level of the internal pressure in the control pressure chamber 200 can be maintained by switching the control valve 400 to the position 400D. In the embodiment shown in FIG. 30, the leakage of the refrigerant from the discharge chamber 93 can be prevented because any continuous communication between the discharge chamber 93 and the control pressure chamber 200 is eliminated, to thereby ensure a higher discharge efficiency of the whole compressor.

Figure 31:
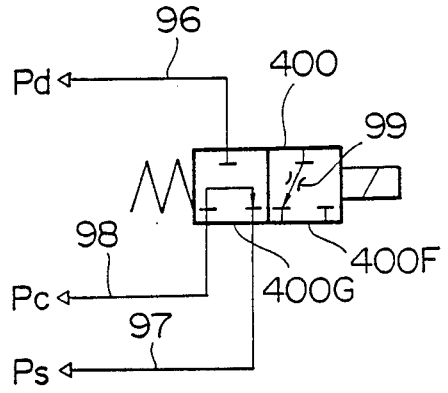
FIG. 31 is an illustration of a still another example of the control valve.

FIG. 31 shows a different embodiment in which the control valve 400 is constituted by a three-way valve which is adapted for selectively changing over the high- and low-pressure introduction passages 96 and 97 and the control pressure passage 98. Namely, the control valve 400 shown in FIG. 31 can take two positions: a first position 400F which enables the control pressure passage 98 to communicate with the high-pressure introduction passage 96 thorugh the restriction orifice 99 and a second position 400G which permits the control pressure passage 98 to communicate with the low-pressure introduction passage 97.

Figure 32:
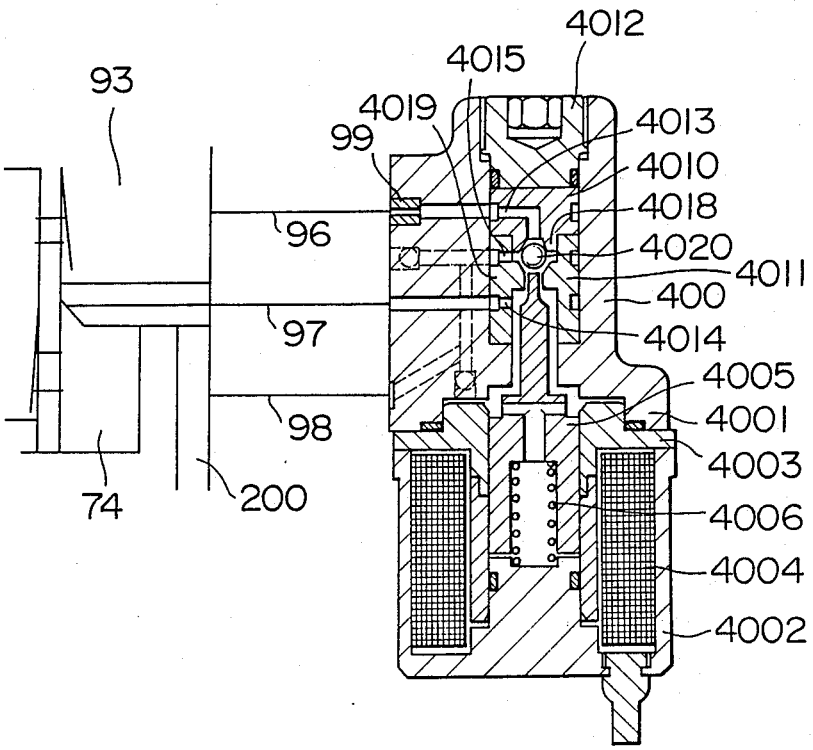
FIG. 32 is a sectional view of the control valve shown in FIG. 31.

FIG. 32 is a sectional view of the control valve 400 shown in FIG. 31. The control valve has a valve housing 4001 made of a non-magnetic material. A coil housing 4002 made of a magnetic material is connected to one end of the valve housing 4001 through a magnetic plate 4003. The coil housing 4002 accommodates a coil 4004 in which is received a stator core constituted by the central portion of the coil housing 4002. A moving core 4005 made of a magnetic material is positioned so as to oppose the stator core portion of the coil housing 4002. The moving core 4005 is biased by a spring 4006 away from the coil housing 4002.

The valve housing 4001 received a first passage member 4010 and a second passage member 4011 which are fastened together by bolts 4012. The first passage member 4010 is formed therein with a high-pressure passage 4013 communicating with the high-pressure introduction passage 96, while the second passage member 4011 is formed therein with a low-pressure passage 4014 communicating with the low-pressure introduction passage 97 and also with a control passage 4015 communicating with the control pressure passage 98. The passages 4015, 4013 and 1014 are communicated respectively with the external passages 98, 96 and 97 through respective passages which are formed in the valve housing 4001.

A first valve seat 4018 is formed in the end of the first passage member 4010 where the high-pressure passage 4013 is formed. The second passage member 4011 is provided with a second valve seat 4019 which is formed in such a manner as to oppose the first valve seat 4018. A valve member 4020 made of a steel ball is disposed between the opposing valve seats 4018 and 4019 so as to be able to contact either one of these valve seats. The moving core 4005 has an end which extends through the second valve seat 4019 into contact with the valve member 4020.

When the coil 4004 is not energized, the moving core 4005 is biased upward as viewed in FIG. 32 by the force of the spring 4006 to keep the valve member 4020 in contact with the first valve seat 4018. Therefore, the control passage 4015 is allowed to communicate with the low-pressure passage 4014 through the second valve seat 4019. In this state, therefore, the low-pressure introduction passage 97 communicates with the control pressure passage 98 so that the suction pressure is introduced to the control pressure chamber 200 (the position 400E in FIG. 30).

When the coil 404 is energized in response to a signal from the controller 500, a magnetic force is produced to act between the coil housing 4002 and the moving core 4005, so that the moving core 4005 is attracted by this magnetic force downwards as viewed in the drawing. In consequence, the valve member 4020 is freed from the pressing force of the moving core 4005. Meanwhile, the pressure in the high-pressure passage 4013 is maintained at the same high level as that in the discharge chamber 93, while the pressure in the low-pressure passage 4014 is maintained at the same low level as that in the suction chamber 74. In consequence, the valve member 4020 is urged against the second valve seat 4019 by the difference between these pressures. In consequence, the high-pressure passage 4013 is made to communicate with the control passage 4015 thorugh the first valve seat 4018. In this state, therefore, the high-pressure introduction passage 96 communicates with the control pressure passage 98, so that the high pressure is transmitted to the control pressure chamber 200 (the position 400F in FIG. 31).

Figure 33:
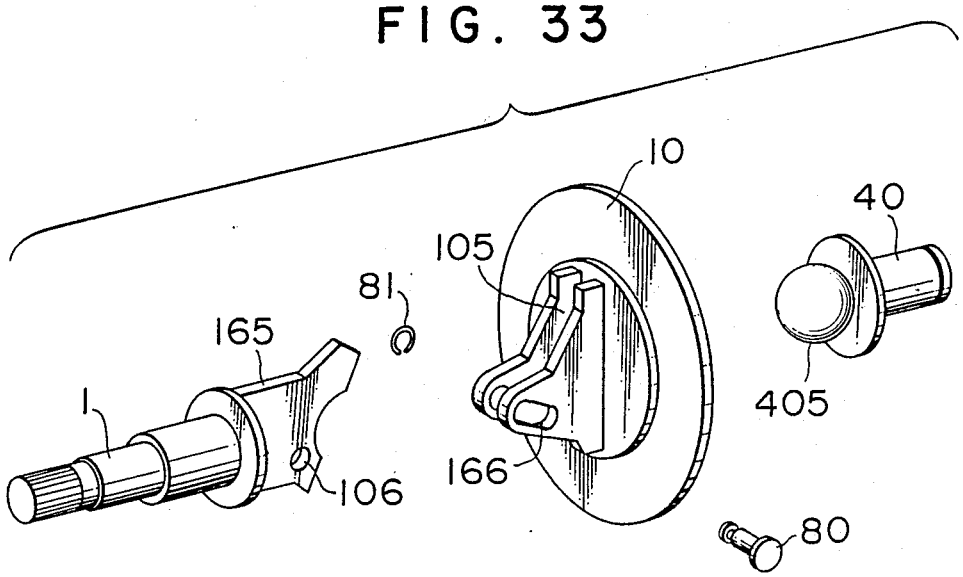
FIG. 33 is a perspective view of a shaft and a swash plate incorporated in a still further embodiment of the swash-plate type compressor of the present invention.
Figure 34:
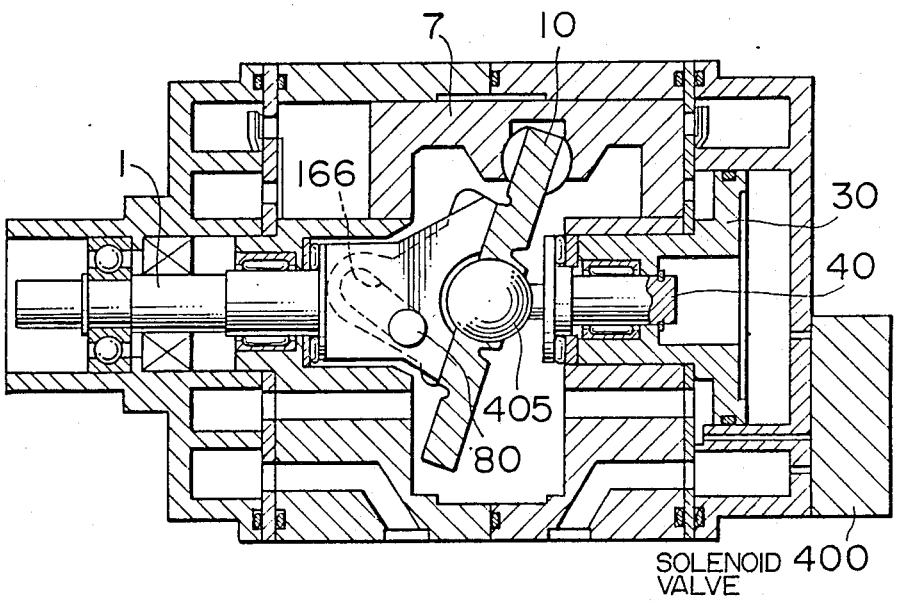
FIGS. 34 and 35 are sectional views of a compressor incorporating the shaft and the swash plate shown in FIG. 33.
Figure 35:
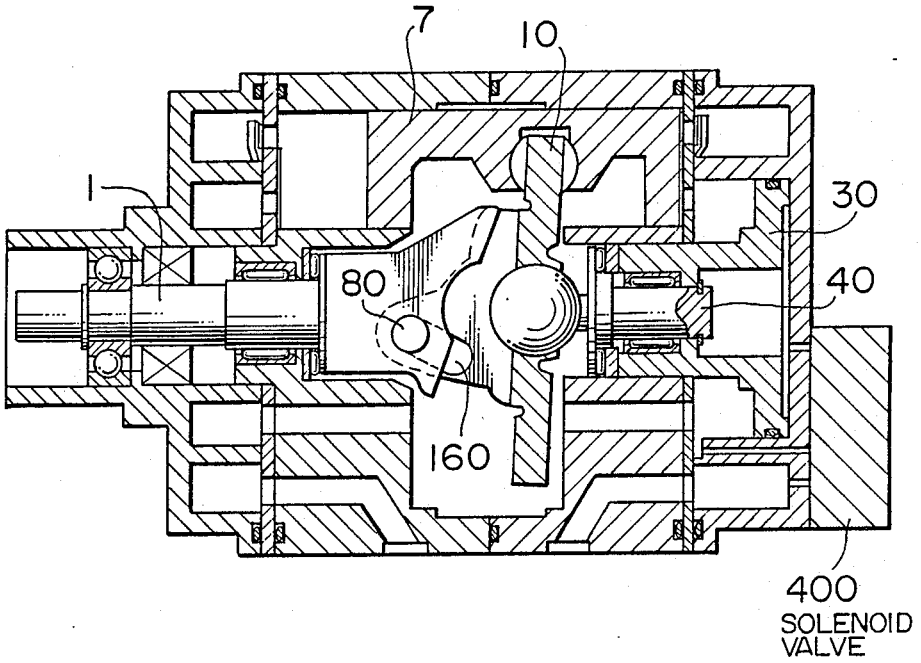

In the embodiment shown in FIG. 3, the elongated slot 166 is formed in the flat web portion 165 on the shaft 1, while the pin-receiving holes 106 and 108 are formed in the members on the swash plate 10 defining the slit 105. This, however, is not exclusive and the relationship between the elongated slot 166 and the pin-receiving holes 106 and 108 may be inverted as shown in FIG. 33. Namely, as will be understood from FIGS. 34 and 35, the same effect as that provided by the arrangement shown in FIG. 3 can be obtainable by arranging such that elongated slots 166 are formed in the walls defining the slit 105 adjacent to the swash plate 10 while a single pin-receiving hole for the pin 80 is formed in the flat web portion 165 of the shaft 1. In addition, the slit 105 may alternatively be provided on the side of the shaft 1 while the flat web portion 165 may alternatively be provided on the side of the swash plate 10.

Figure 36:
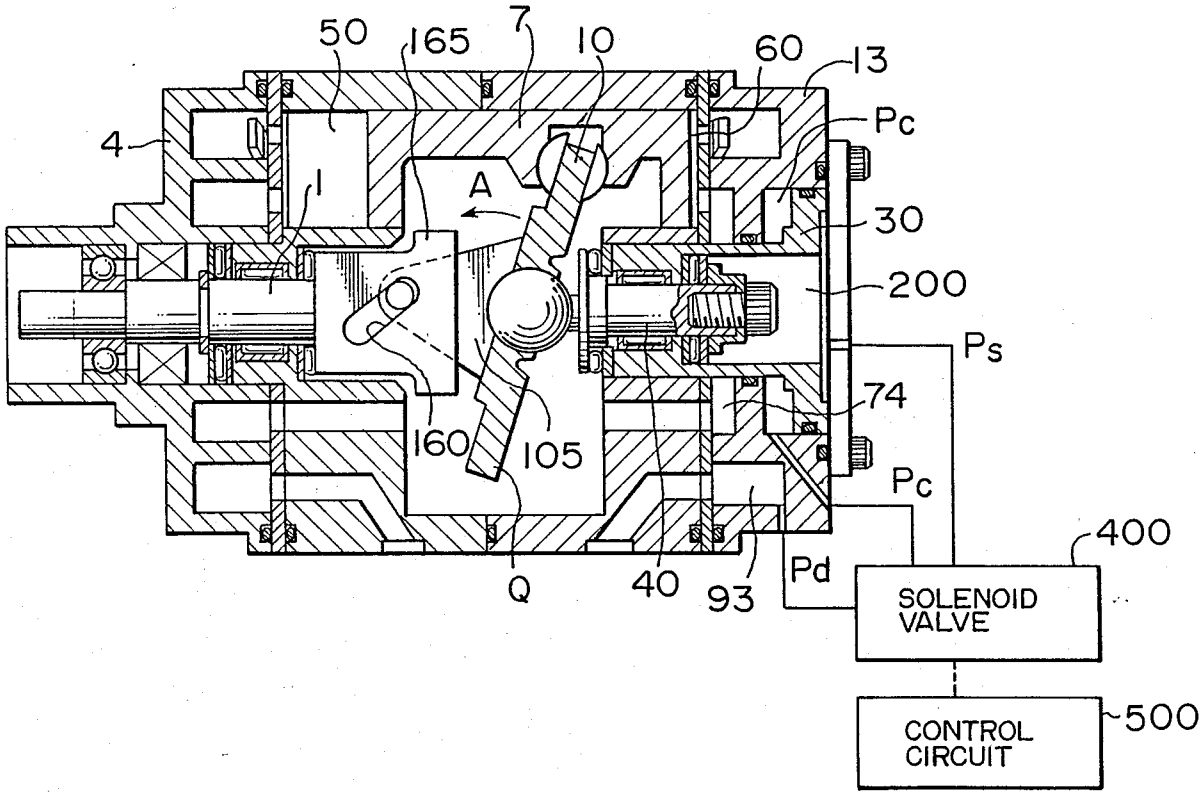
FIGS. 36 and 37 are sectional views of a still further embodiment of the swash-plate type compressor of the present invention.
Figure 37:
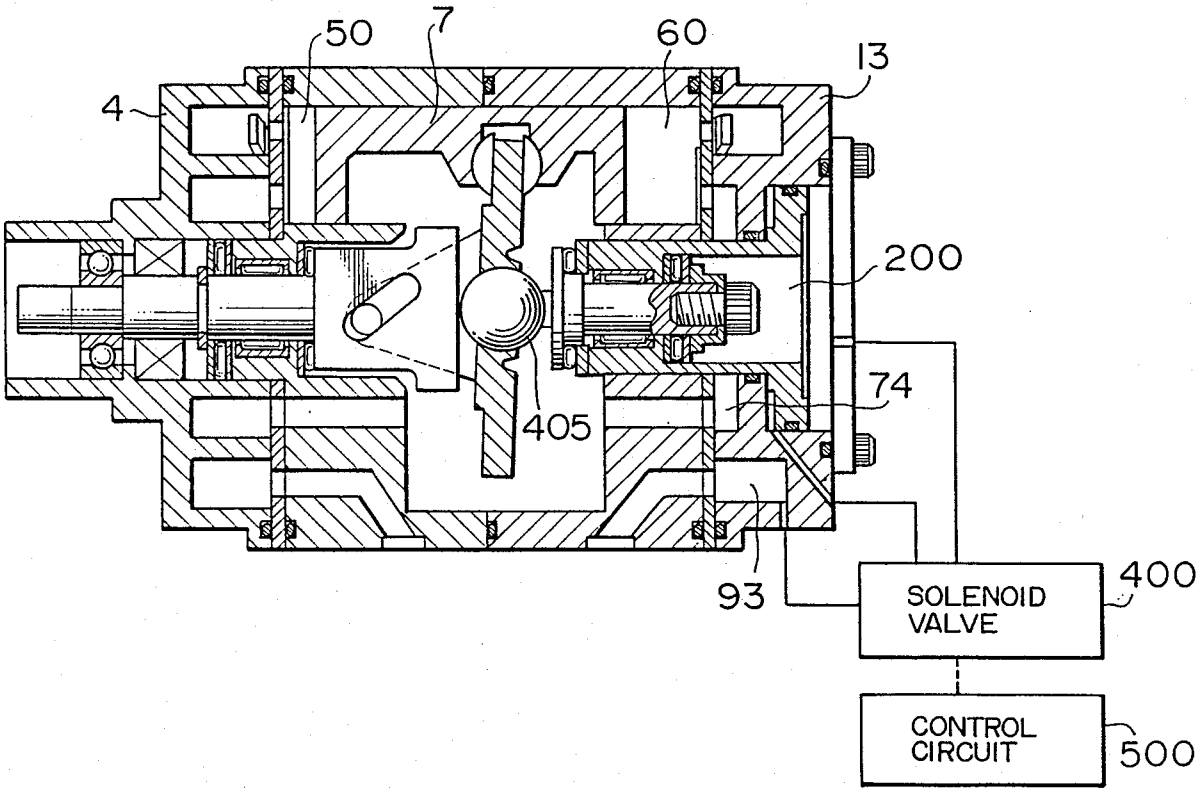

In the embodiments described hereinbefore, the pistons work only in the working chambers 60 adjacent to the rear housing 13 when the displacement of the compressor has been decreased. However, the arrangement may be reversed. Namely, the suction and compression are conducted only in the working chambers 50 adjacent to the front housing 4 when the displacement of the compressor has been decreased to the minimum, as shown in FIGS. 36 and 37. In this case, the spool 30 which serves to reduce the angle of tilt of the swash plate 10 also acts through the spherical support portion 405 to move the center of rotation of the swash plate 10 towards the front housing 4. It will be understood that, in the embodiment shown in FIGS. 36 nnd 37, the discharge pressure in the discharge chamber 93 is introduced into the control pressure chamber 200 when it is desired to reduce the displacement of the compressor. Conversely, the pressure in the suction chamber 74 is introduced into the control pressure chamber 200 when it is desired to increase the displacement of the compressor.

It is also to be understood that, in the described embodiments, the minimum displacement of the compressor is set to be around 10% of the maximum displacement in order to obtain the pressure differential necessary for actuating the spool, but the minimum displacement may be set to be 0% if the spool is designed to be moved by an external pressure or by means of an external actuator such as a motor.

In the described embodiments of the swash-plate type compressor of the invention, a clearance of 2 to 3 mm is left between the radial end extremity 199 of the swash plate 10 and each piston 7. Such a large clearance would undesirably allow the piston 7 to rotate within each cylinder, causing noises due to collision between the flat surfaces 307 (see FIG. 39) and the end extremity 199 of the swash plate 10.

Figure 39:
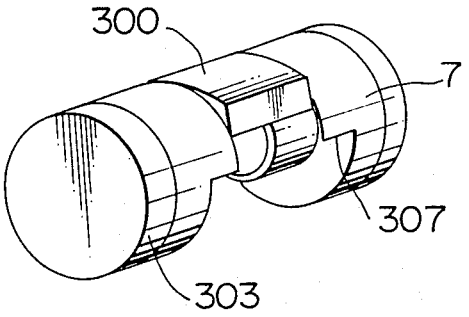
FIG. 39 is a perspective view of a piston.

In an embodiment of the present invention, therefore, each piston 7 is provided with a rotation prevention means 300 which is integrally formed on the piston 7 as shown in FIG. 38 and 39. In the illustrated embodiment, the rotation-prevention means 300 has the form of a substantially flat portion formed on a mid position of each piston 7 as shown in FIG. 39 and adapted to fit in an engaging recess 310 formed in the wall of each cylinder, as shown in FIG. 38. It will be seen that the rotation-prevention means 300 and the engaging recess 310 cooperate to prevent the piston 7 from rotating about its own axis, thereby suppressing occurrence of noise during operation of the compressor.

What is claimed is:

1. A variable displacement swash-plate type compressor comprising:

a cylinder block having a plurality of cylinder bores therein;

a shaft rotatably supported in said cylinder block;

a swash plate tiltably connected to said shaft and adapted to be rotated together with said shaft;

pistons slidably received in said cylinder bores and adapted to be reciprocally moved in said cylinder bores in accordance with an oscillatory motion of said swash plate;

working chambers formed between both ends of each of said pistons and adjacent surfaces of an associated cylinder bore;

a support portion disposed coaxially with said shaft and supporting a central portion of said swash plate rotatably and tiltably; and a spool for driving said support portion axially of said shaft, to move said central portion of said swash plate axially of said shaft to change the angle of tilt of said swash plate, whereby the strokes of reciprocatory movements of said pistons in said cylinder bores are changed, the arrangement being such that each piston can have strokes to a first position in one of the working chambers associated with the piston and to a second position in the other working chamber, the piston stroke to said first position being different from the piston stroke to said second position.

2. A variable displacement swash-plate type compressor according to claim 1, wherein said support portion has a spherical support surface which rotatably and slidably engages with a spherical surface portion formed on said central portion of said swash plate.

3. A variable displacement swash-plate type compressor according to claim 1, wherein said shaft extends through said swash plate and said spool is slidably mounted on said shaft.

4. A variable displacement swash-plate type compressor according to claim 1, wherein said shaft is disposed only on one side of said swash plate.

5. A variable displacement swash-plate type compressor according to claim 1, wherein said shaft is provided with a flat web portion while said swash plate has a slit in which said flat web portion is received, whereby said swash plate is tiltably connected to said shaft through the engagement between said flat web portion and said slit.

6. A variable displacement swash-plate type compressor according to claim 1, wherein when the strokes of reciprocatory movements of said pistons in said cylinder bores are changed by a change in the angle of tilt of said swash plate, the top dead center of each piston is so positioned in the working chamber on one side of the piston that no dead volume is formed in said working chamber regardless of the change in the angle of tilt of said swash plate.

7. A variable displacement swash-plate type compressor according to claim 5, wherein said flat web portion has a slit while portions of said swash plate defining said slit have pin-receiving holes, whereby said swash plate is tiltably connected to said shaft by means of a pin extending through said slot and receive in said pin-receiving holes.

8. A variable displacement swash-plate type compressor according to claim 5, wherein said flat web portion has a pin-receiving hole while portions of said swash plate defining said slit have slots, whereby said swash plate is tiltably connected to said shaft by means of a pin extending through said slots and received in said pin-receiving hole.

9. A variable displacement swash-plate type compressor according to claim 8, wherein said pin is rotationably held in said pin-receiving hole through the intermediary of a bearing.

10. A variable displacement swash-plate type compressor comprising:

a cylinder block having at least one cylinder bore therein;

a shaft rotatably supported in said cylinder block;

a swash plate tiltably connected to said shaft and adapted to be rotated together with said shaft;

pistons slidably received in said cylinder bores and adapted to reciprocatorily stroke in said cylinder bores in accordance with an oscillatory motion of said swash plate;

working chambers formed between both ends of each of said pistons and adjacent surfaces of an associated cylinder bore;

a support portion disposed coaxially with said shaft and supporting a central portion of said swash plate rotatably and tiltably;

a spool for driving said support portion axially of said shaft;

a control pressure chamber provided on a side of said spool opposite to said support portion such that said spool is moved axially of said shaft in accordance with an internal pressure of said control pressure chamber; and a control valve for controlling a signal pressure to be introduced into said control pressure chamber, said spool being driven in accordance with the signal pressure in said control pressure chamber to move a central portion of said swash plate axially of said shaft and vary the angle of tilt of said swash plate.

11. A variable displacement swash-plate type compressor according to claim 10, wherein a plurality of such cylinder bores are formed in said cylinder block and extend in parallel with one another

12. A variable displacement swash-plate type compressor according to claim 10, wherein said control valve includes a control pressure passage communicating with said control pressure chamber, a high pressure introduction passage for introducing pressure available at the discharge side of said compressor, a low pressure introduction passage for introducing pressure available at the suction side of said compressor and a change-over valve for selectively bringing either one of said high and low pressure introduction passages into communication with said control pressure passage.

13. A variable displacement swash-plate type compressor according to claim 10, wherein said control pressure chamber is communicated with the discharge side of said compressor through a flow resistance means, and wherein said control valve includes a control pressure passage communicating with said control pressure chamber, a low pressure introduction passage for introducing pressure available at the suction side of said compressor, and a valve member for selectively connecting and disconnecting said low pressure introduction passage to and from said control pressure chamber.

14. A variable displacement swash-plate type compressor comprising:

a cylinder block having cylinder bores therein;

a shaft rotatably supported in said cylinder block;

a swash plate tiltably connected to said shaft and adapted to be rotated together with said shaft;

pistons slidably received in said cylinder bores and adapted to reciprocatorily stroke in said cylinder bores in accordance with an oscillatory motion of said swash plate;

working chambers formed between both ends of each of said pistons and adjacent surfaces of said cylinder bores;

a support portion disposed coaxially with said shaft and adapted to support a central portion of said swash plate rotatably and oscillatably;

a spool for driving said support portion axially of said shaft;

control means for driving said spool axially of said shaft between a maximum displacement position in which the angle of tilt of said spool is maximized and a minimum displacement position in which the angle of tilt of said swash plate is minimized; and auxiliary loading means operative when said control means has driven said spool more than a predetermined distance from said minimum displacement position to apply to said spool a load which acts to suppress the movement of said spool towards said maximum displacement position more than said predetermined distance from said minimum displacement position;

the movement of said spool displacing said central portion of said swash plate axially of said shaft and changing the angle of tilt of said swash plate.

15. A variable displacement swash-plate type compressor according to claim 14, wherein said auxiliary loading means comprise a spring means.

16. A variable displacement swash-plate type compressor according to claim 15, wherein said spring means is disposed between said spool and one end of said shaft in such a manner that the compression of said spring means is commenced when said spool has traveled in excess of said predetermined distance.

17. A variable displacement swash-plate type compressor according to claim 15, wherein said spring means is disposed between said spool and said cylinder block in such a manner that the loading by said spring means is commenced when said spool has traveled in excess of said predetermined distance.

18. A variable displacement swash-plate type compressor according to claim 15, further including an end plate attached to an end of said cylinder block and covering said working chambers, and wherein said spring means is disposed between said spool and said end plate in such a manner that said spring means becomes effective to produce a resilient load when said spool has traveled in excess of said predetermined distance.

19. A variable displacement swash-plate type compressor according to claim 15, wherein said spring means is disposed between said support portion and a retainer portion provided on said shaft so as to oppose said support portion, said spring means becoming effective to produce a resilient load when said support portion has traveled in excess of said predetermined distance.

20. A variable displacement swash-plate type compressor comprising:

a cylinder block having cylinder bores therein;

a shaft rotatably supported in said cylinder block;

a swash plate tiltably connected to said shaft and adapted to be rotated together with said shaft;

pistons slidably received in said cylinder bores and adapted. to reciprocally stroke in said cylinder bores in accordance with an oscillatory motion of said swash plate;

working chambers formed between both ends of each of said pistons and adjacent surfaces of said cylinder bores;

a support portion disposed coaxially with said shaft and adapted to support a central portion of said swash plate rotatably and oscillatably;

a spool for driving said support portion axially of said shaft;

control means for driving said spool axially of said shaft to move said central portion of said swash plate axially of said shaft while changing the angle of tilt of said swash plate, thereby causing the strokes of reciprocatory movements of said pistons in said cylinder bores to vary in such a manner that the position of the stroke end of each piston in a first working chamber on one end thereof id different from the position of the stroke end of said piston in a second, variable volume chamber one the other end of said piston; and auxiliary biasing means for applying a biasing force acting in a direction from said first working chamber towards said second, variable volume chamber so as to produce a torque which acts in the direction to reduce the angle of tilt of said swash plate.

21. A variable displacement swash-plate type compressor according to claim 20, further including:

a flat web portion formed on one of said shaft and said swash plate;

a slit provided in the other of said swash plate and said shaft for receiving said web portion;

a slot formed in said web portion;

pin-receiving holes formed in portions which define said slit;

a pin extending through said slot and received in said pin-receiving holes so as to tiltably connect said swash plate to said shaft;

said slot being arcuate such that, when the angle of tilt of said swash plate is maximum, an apparent point of hinge between said swash plate and each of the pistons is located substantially at a center of the piston and such that, when the angle of tilt of said swash plate is minimum, said apparent hinge point is offset from said center of each piston towards said support portion.

22. A variable displacement swash-plate type compressor according to claim 20, wherein said control means is operative to drive said spool in dependence on a difference between a high compressor discharge pressure and a low compressor suction pressure, and wherein said auxiliary biasing means is operative to subject said control means to one of a low pressure lower than the low compressor suction pressure and a high pressure high than said high compressor discharge pressure.

23. A variable displacement swash-plate type compressor according to claim 20, wherein said auxiliary biasing means comprises a spring which applies a load to said spool in a direction to reduce the amount of movement of said spool towards said support portion.

24. A variable displacement swash-plate type compressor according to claim 23, wherein said spring is disposed to contact at its ends with said spool and with said shaft.

25. A variable displacement swash-plate type compressor according to claim 20, wherein said first working chamber has a dead space formed therein when the angle of tilt of said swash plate is reduced and wherein said auxiliary biasing means comprises a boosting passage means which introduces the discharge pressure of said compressor into said first working chamber.

26. A variable displacement swash-plate type compressor according to claim 25, wherein said auxiliary biasing means comprises a communication means which provides communication between said first working chamber and a discharge chamber, said discharge chamber communicating with said second, variable volume chamber through a discharge port, and a discharge valve.

27. A variable displacement swash-plate type compressor according to claim 26, further including a side plate provided on one end surface of said cylinder block, said side plate having said first working chamber and said discharge port through which said second, variable volume chamber communicates with said discharge chamber, said communicating means being provided in said side plate.

28. A variable displacement swash-plate type compressor according to claim 26, wherein said communicating means comprises a relief port formed in said discharge valve.

29. A variable displacement swash-plate type compressor according to claim 20, wherein said auxiliary biasing means comprises a dead volume generating means for changing the position of stroke end of said piston in said second, variable volume chamber and establishing a dead volume on the end of said piston in said second, variable volume chamber.

30. A variable displacement swash-plate type compressor according to claim 29, further including:

a flat web portion formed on one of said shaft and said swash plate;

a slit provided in the other of said swash plate and said shaft for receiving said web portion;

a slot formed in said flat web portion;

pin-receiving holes formed in portions which define said slit; and a pin extending through said slot and received in said pin-receiving holes so as to tiltably connect said swash plate to said shaft;

said slot being so designed that, when the angle of tilt of said swash plate is decreased as a result of movement of said spool, a dead volume is formed in said second variable volume chamber.

31. A variable displacement swash-plate type compressor according to claim 20, wherein, in accordance with the angle of tilt of said swash plate, a dead space is formed in said first working chamber adjacent to one end of an associated piston, while the piston is movable in said second working chamber to positions predetermined for the suction, compression and discharge of a fluid regardless of the angle of tilt of said swash plate, and wherein said auxiliary biasing means comprises a restriction formed in a suction passage means through which the fluid is sucked into the second working chamber.

32. A variable displacement swash-plate type compressor according to claim 31, wherein said restriction is formed in said spool and variable by the movement of said spool to vary the rate of suction through said suction passage.

33. A variable displacement swash-plate type compressor according to claim 31, wherein said restriction is arranged such that the rate of restriction of the flow of the fluid through said suction passage is low when the angle of tilt of said swash-plate is great and such that the rate of restriction is high when the angle of tilt is small.

34. A variable displacement swash-plate type compressor according to claim 10, wherein said control valve is operative to selectively introduce a suction pressure of the compressor and a discharge pressure thereof into said control pressure chamber to change over the signal pressure in said control pressure chamber between said suction pressure and said discharge pressure;

the arrangement being such that, when the discharge pressure is introduced into said control pressure chamber, said spool is driven by the signal pressure in said control pressure chamber to move said support portion in a direction to increase the angle of tilt of said swash plate, such that, when the suction pressure is introduced into said control pressure chamber, said support portion and said spool are moved in a direction to decrease the angle of tilt of said swash plate by the compression reactional force acting on said pistons, and such that, in the working chamber adjacent tó one end of each piston, the piston can always stroke to positions predetermined for suction, compression and discharge of a fluid regardless of the change in the angle of tilt of said swash plate and, in the working chamber adjacent to the other end of the piston, a dead space is formed in accordance with the angle of tilt of said swash plate.

* * * * *